US011491376B2

(12) United States Patent
Honea et al.

(10) Patent No.: US 11,491,376 B2
(45) **Date of Patent: *Nov. 8, 2022**

(54) GOLF CLUB

(71) Applicant: Taylor Made Golf Company, Inc., Carlsbad, CA (US)

(72) Inventors: Justin Honea, Richardson, TX (US); Tim Reed, McKinney, TX (US); John Kendall, Wylie, TX (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/215,713

(22) Filed: Mar. 29, 2021

(65) Prior Publication Data

US 2021/0213334 A1 Jul. 15, 2021

Related U.S. Application Data

(63) Continuation of application No. 16/853,159, filed on Apr. 20, 2020, now Pat. No. 10,974,106, which is a continuation of application No. 16/458,916, filed on Jul. 1, 2019, now Pat. No. 10,625,125, which is a continuation of application No. 16/108,299, filed on Aug. 22, 2018, now Pat. No. 10,335,649, which is a continuation of application No. 15/632,417, filed on Jun. 26, 2017, now Pat. No. 10,058,747, which is a continuation of application No. 14/865,379, filed on Sep. 25, 2015, now Pat. No. 9,687,700, which is a continuation of application No. 14/060,948, filed on Oct. 23, 2013, now Pat. No. 9,168,431, which is a continuation of application No. 13/716,437, filed on Dec. 17, 2012, now Pat. No. 8,591,353, which is a continuation of application No. 13/476,321, filed on (Continued)

(51) Int. Cl.
*A63B 53/04* (2015.01)

(52) U.S. Cl.
CPC ..... *A63B 53/0466* (2013.01); *A63B 53/0408* (2020.08); *A63B 53/0412* (2020.08); *A63B 53/0433* (2020.08); *A63B 53/0445* (2020.08); *A63B 2209/00* (2013.01)

(58) Field of Classification Search
CPC ..... A63B 53/0408; A63B 53/0466; A63B 53/047; A63B 53/0475
USPC ..... 473/324–350
See application file for complete search history.

(56) References Cited

U.S. PATENT DOCUMENTS 411,000 A 9/1889 Anderson
1,133,129 A 3/1915 Govan
(Continued)

FOREIGN PATENT DOCUMENTS

CN 2436182 6/2001
DE 9012884 9/1990
(Continued)

OTHER PUBLICATIONS

Mike Stachura, "The Hot List", Golf Digest Magazine, Feb. 2004, pp. 82-86.

(Continued)

*Primary Examiner* — Alvin A Hunter
(74) *Attorney, Agent, or Firm* — Dawsey Co., LPA; David J. Dawsey

(57) ABSTRACT

A golf club having unique mass properties and all the benefits afforded therefrom.

20 Claims, 22 Drawing Sheets

Related U.S. Application Data

May 21, 2012, now Pat. No. 8,357,058, which is a continuation of application No. 12/609,209, filed on Oct. 30, 2009, now Pat. No. 8,206,244, which is a continuation-in-part of application No. 11/972,368, filed on Jan. 10, 2008, now Pat. No. 7,632,196.

(56) References Cited

U.S. PATENT DOCUMENTS 1,518,316 A 12/1924 Ellingham
1,526,438 A 2/1925 Scott
1,538,312 A 5/1925 Beat
1,592,463 A 7/1926 Marker
1,658,581 A 2/1928 Tobia
1,704,119 A 3/1929 Buhrke
1,970,409 A 8/1934 Wiedemann
D107,007 S 11/1937 Cashmore
2,214,356 A 9/1940 Wettlaufer
2,225,930 A 12/1940 Sexton
2,360,364 A 10/1944 Reach
2,375,249 A 5/1945 Richer
2,460,435 A 2/1949 Schaffer
2,681,523 A 6/1954 Sellers
3,064,980 A 11/1962 Steiner
3,085,804 A 4/1963 Pieper
3,166,320 A 1/1965 Onions
3,466,047 A 9/1969 Rodia et al.
3,486,755 A 12/1969 Hodge
3,556,533 A 1/1971 Hollis
3,589,731 A 6/1971 Chancellor
3,606,327 A 9/1971 Gorman
3,610,630 A 10/1971 Glover
3,652,094 A 3/1972 Glover
3,672,419 A 6/1972 Fischer
3,692,306 A 9/1972 Glover
3,743,297 A 7/1973 Dennis
3,893,672 A 7/1975 Schonher
3,897,066 A 7/1975 Belmont
3,976,299 A 8/1976 Lawrence et al.
3,979,122 A 9/1976 Belmont
3,979,123 A 9/1976 Belmont
3,985,363 A 10/1976 Jepson et al.
3,997,170 A 12/1976 Goldberg
4,008,896 A 2/1977 Gordos
4,043,563 A 8/1977 Churchward
4,052,075 A 10/1977 Daly
4,065,133 A 12/1977 Gordos
4,076,254 A 2/1978 Nygren
4,077,633 A 3/1978 Studen
4,085,934 A 4/1978 Churchward
4,121,832 A 10/1978 Ebbing
4,139,196 A 2/1979 Riley
4,147,349 A 4/1979 Jeghers
4,150,702 A 4/1979 Holmes
4,165,076 A 8/1979 Celia
4,189,976 A 2/1980 Becker
4,193,601 A 3/1980 Reid, Jr. et al.
4,214,754 A 7/1980 Zebelean
D256,709 S 9/1980 Reid, Jr. et al.
4,247,105 A 1/1981 Jeghers
4,262,562 A 4/1981 MacNeill
D259,698 S 6/1981 MacNeill
4,340,229 A 7/1982 Stuff, Jr.
4,411,430 A 10/1983 Dian
4,423,874 A 1/1984 Stuff, Jr.
4,431,192 A 2/1984 Stuff, Jr.
4,438,931 A 3/1984 Motomiya
4,489,945 A 12/1984 Kobayashi
4,527,799 A 7/1985 Solheim
4,530,505 A 7/1985 Stuff
D284,346 S 6/1986 Masters
4,592,552 A 6/1986 Garber
4,602,787 A 7/1986 Sugioka et al.
4,607,846 A 8/1986 Perkins
4,712,798 A 12/1987 Preato
4,730,830 A 3/1988 Tilley
4,736,093 A 4/1988 Braly
4,754,974 A 7/1988 Kobayashi
4,754,977 A 7/1988 Sahm
4,762,322 A 8/1988 Molitor et al.
4,787,636 A 11/1988 Honma
4,795,159 A 1/1989 Nagamoto
4,803,023 A 2/1989 Enomoto et al.
4,867,457 A 9/1989 Lowe
4,867,458 A 9/1989 Sumikawa et al.
4,869,507 A 9/1989 Sahm
4,881,739 A 11/1989 Garcia
4,895,367 A 1/1990 Kajita et al.
4,895,371 A 1/1990 Bushner
4,915,558 A 4/1990 Muller
4,919,428 A 4/1990 Perkins
4,962,932 A 10/1990 Anderson
4,994,515 A 2/1991 Washiyama et al.
5,006,023 A 4/1991 Kaplan
5,020,950 A 6/1991 Ladouceur
5,028,049 A 7/1991 McKeighen
5,039,267 A 8/1991 Wollar
5,050,879 A 9/1991 Sun et al.
5,058,895 A 10/1991 Igarashi
5,078,400 A 1/1992 Desbiolles et al.
5,092,599 A 3/1992 Okumoto et al.
5,116,054 A 5/1992 Johnson
5,121,922 A 6/1992 Harsh, Sr.
5,122,020 A 6/1992 Bedi
5,172,913 A 12/1992 Bouquet
5,190,289 A 3/1993 Nagai et al.
5,193,810 A 3/1993 Antonious
5,221,086 A 6/1993 Antonious
5,244,210 A 9/1993 Au
5,251,901 A 10/1993 Solheim et al.
5,253,869 A 10/1993 Dingle et al.
5,255,919 A 10/1993 Johnson
D343,558 S 1/1994 Latraverse et al.
5,297,794 A 3/1994 Lu
5,301,944 A 4/1994 Koehler
5,316,305 A 5/1994 McCabe
5,318,297 A 6/1994 Davis et al.
5,320,005 A 6/1994 Hsiao
5,328,176 A 7/1994 Lo
5,340,106 A 8/1994 Ravaris
5,346,217 A 9/1994 Tsuchiya et al.
5,385,348 A 1/1995 Wargo
5,395,113 A 3/1995 Antonious
5,410,798 A 5/1995 Lo
5,419,556 A 5/1995 Take
5,421,577 A 6/1995 Kobayashi
5,429,365 A 7/1995 McKeighen
5,439,222 A 8/1995 Kranenberg
5,441,274 A 8/1995 Clay
5,447,309 A 9/1995 Vincent
5,449,260 A 9/1995 Whittle
D365,615 S 12/1995 Shimatani
5,482,280 A 1/1996 Yamawaki
5,511,786 A 4/1996 Antonious
5,518,243 A 5/1996 Redman
5,533,730 A 7/1996 Ruvang
5,558,332 A 9/1996 Cook
D375,130 S 10/1996 Hlinka et al.
5,564,705 A 10/1996 Kobayashi et al.
5,571,053 A 11/1996 Lane
5,582,553 A 12/1996 Ashcraft et al.
5,613,917 A 3/1997 Kobayashi et al.
D378,770 S 4/1997 Hlinka et al.
5,620,379 A 4/1997 Borys
5,624,331 A 4/1997 Lo et al.
5,629,475 A 5/1997 Chastonay
5,632,694 A 5/1997 Lee
5,632,695 A 5/1997 Hlinka et al.
5,658,206 A 8/1997 Antonious
5,669,827 A 9/1997 Nagamoto
5,683,309 A 11/1997 Reimers
5,688,189 A 11/1997 Bland
5,695,412 A 12/1997 Cook
5,700,208 A 12/1997 Nelms

(56) References Cited

U.S. PATENT DOCUMENTS 5,709,613 A 1/1998 Sheraw
5,718,641 A 2/1998 Lin
5,720,674 A 2/1998 Galy
D392,526 S 3/1998 Nicely
5,746,664 A 5/1998 Reynolds, Jr.
5,755,627 A 5/1998 Yamazaki et al.
5,759,114 A 6/1998 Bluto et al.
5,762,567 A 6/1998 Antonious
5,766,095 A 6/1998 Antonious
5,769,737 A 6/1998 Holladay et al.
5,776,010 A 7/1998 Helmstetter et al.
5,776,011 A 7/1998 Su et al.
5,785,608 A 7/1998 Collins
5,788,587 A 8/1998 Tseng
5,798,587 A 8/1998 Lee
RE35,955 E 11/1998 Lu
5,851,160 A * 12/1998 Rugge ..... A63B 60/00 473/349
5,876,293 A 3/1999 Musty
5,885,166 A 3/1999 Shiraishi
5,890,971 A 4/1999 Shiraishi
D409,463 S 5/1999 McMullin
5,908,356 A 6/1999 Nagamoto
5,911,638 A 6/1999 Parente et al.
5,913,735 A 6/1999 Kenmi
5,916,042 A 6/1999 Reimers
D412,547 S 8/1999 Fong
5,935,019 A 8/1999 Yamamoto
5,935,020 A 8/1999 Stites et al.
5,941,782 A 8/1999 Cook
5,947,840 A 9/1999 Ryan
5,954,595 A 9/1999 Antonious
5,967,905 A 10/1999 Nakahara et al.
5,971,867 A 10/1999 Galy
5,976,033 A 11/1999 Takeda
5,997,415 A 12/1999 Wood
6,001,029 A 12/1999 Kobayashi
6,015,354 A 1/2000 Ahn et al.
6,017,177 A 1/2000 Lanham
6,019,686 A 2/2000 Gray
6,023,891 A 2/2000 Robertson et al.
6,032,677 A 3/2000 Man et al.
6,033,318 A 3/2000 Drajan, Jr. et al.
6,033,319 A 3/2000 Farrar
6,033,321 A 3/2000 Yamamoto
6,048,278 A 4/2000 Meyer et al.
6,056,649 A 5/2000 Imai
6,062,988 A 5/2000 Yamamoto
6,074,308 A 6/2000 Domas
6,077,171 A 6/2000 Yoneyama
6,083,115 A 7/2000 King
6,089,994 A 7/2000 Sun
6,093,113 A 7/2000 Mertens
6,123,627 A 9/2000 Antonious
6,146,286 A 11/2000 Masuda
6,149,533 A 11/2000 Finn
6,162,132 A 12/2000 Yoneyama
6,162,133 A 12/2000 Peterson
6,168,537 B1 1/2001 Ezawa
6,171,204 B1 1/2001 Starry
6,186,905 B1 2/2001 Kosmatka
6,190,267 B1 2/2001 Marlowe et al.
6,193,614 B1 2/2001 Sasamoto et al.
6,203,448 B1 3/2001 Yamamoto
6,206,789 B1 3/2001 Takeda
6,206,790 B1 3/2001 Kubica et al.
6,210,290 B1 4/2001 Erickson et al.
6,217,461 B1 4/2001 Galy
6,238,303 B1 5/2001 Fite
6,244,974 B1 6/2001 Hanberry, Jr.
6,248,025 B1 6/2001 Murphey et al.
6,254,494 B1 7/2001 Hasebe et al.
6,264,414 B1 7/2001 Hartmann et al.
6,270,422 B1 8/2001 Fisher
6,277,032 B1 8/2001 Smith
6,290,609 B1 9/2001 Takeda
6,296,579 B1 10/2001 Robinson
6,299,547 B1 10/2001 Kosmatka
6,306,048 B1 10/2001 McCabe et al.
6,325,728 B1 12/2001 Helmstetter et al.
6,334,817 B1 1/2002 Ezawa et al.
6,338,683 B1 1/2002 Kosmatka
6,340,337 B2 1/2002 Hasebe et al.
6,348,012 B1 2/2002 Erickson et al.
6,348,013 B1 2/2002 Kosmatka
6,348,014 B1 2/2002 Chiu
6,364,788 B1 4/2002 Helmstetter et al.
6,371,868 B1 4/2002 Galloway et al.
6,379,264 B1 4/2002 Forzano
6,379,265 B1 4/2002 Hirakawa et al.
6,383,090 B1 5/2002 Odoherty et al.
6,386,987 B1 5/2002 Lejeune, Jr.
6,386,990 B1 5/2002 Reyes et al.
6,390,933 B1 5/2002 Galloway et al.
6,409,612 B1 6/2002 Evans et al.
6,425,832 B2 7/2002 Cackett et al.
6,434,811 B1 8/2002 Helmstetter et al.
6,435,977 B1 8/2002 Helmstetter et al.
6,436,142 B1 8/2002 Paes et al.
6,440,009 B1 8/2002 Guibaud et al.
6,440,010 B1 8/2002 Deshmukh
6,443,851 B1 9/2002 Liberatore
6,458,042 B1 10/2002 Chen
6,458,044 B1 10/2002 Vincent et al.
6,461,249 B2 10/2002 Liberatore
6,464,598 B1 10/2002 Miller
6,471,604 B2 10/2002 Hocknell et al.
6,475,101 B2 11/2002 Burrows
6,475,102 B2 11/2002 Helmstetter et al.
6,491,592 B2 12/2002 Cackett et al.
6,508,978 B1 1/2003 Deshmukh
6,514,154 B1 2/2003 Finn
6,524,194 B2 2/2003 McCabe
6,524,197 B2 2/2003 Boone
6,524,198 B2 2/2003 Takeda
6,527,649 B1 3/2003 Neher et al.
6,530,847 B1 3/2003 Antonious
6,530,848 B2 3/2003 Gillig
6,533,679 B1 3/2003 McCabe et al.
6,547,676 B2 4/2003 Cackett et al.
6,558,273 B2 5/2003 Kobayashi et al.
6,565,448 B2 5/2003 Cameron
6,565,452 B2 5/2003 Helmstetter et al.
6,569,029 B1 5/2003 Hamburger
6,569,040 B2 5/2003 Bradstock
6,572,489 B2 6/2003 Miyamoto et al.
6,575,845 B2 6/2003 Galloway et al.
6,582,323 B2 6/2003 Soracco et al.
6,592,468 B2 7/2003 Mncent et al.
6,602,149 B1 8/2003 Jacobson
6,605,007 B1 8/2003 Bissonnette et al.
6,607,452 B2 8/2003 Helmstetter et al.
6,612,938 B2 9/2003 Murphey et al.
6,616,547 B2 9/2003 Vincent et al.
6,620,056 B2 9/2003 Galloway et al.
6,638,180 B2 10/2003 Tsurumaki
6,638,183 B2 10/2003 Takeda
6,641,487 B1 11/2003 Hamburger
6,641,490 B2 11/2003 Ellemor
6,648,772 B2 11/2003 Vincent et al.
6,648,773 B1 11/2003 Evans
6,652,387 B2 11/2003 Liberatore
6,663,504 B2 12/2003 Hocknell et al.
6,663,506 B2 12/2003 Nishimoto et al.
6,669,571 B1 12/2003 Cameron et al.
6,669,577 B1 12/2003 Hocknell et al.
6,669,578 B1 12/2003 Evans
6,669,580 B1 12/2003 Cackett et al.
6,676,536 B1 1/2004 Jacobson
6,679,786 B2 1/2004 McCabe
6,716,111 B2 4/2004 Liberatore
6,716,114 B2 4/2004 Nishio
6,719,510 B2 4/2004 Cobzaru
6,719,641 B2 4/2004 Dabbs et al.

(56) References Cited

U.S. PATENT DOCUMENTS 6,719,645 B2 4/2004 Kouno
6,723,002 B1 4/2004 Barlow
6,739,982 B2 5/2004 Murphy et al.
6,739,983 B2 5/2004 Helmstetter et al.
6,743,118 B1 6/2004 Soracco
6,749,523 B1 6/2004 Forzano
6,757,572 B1 6/2004 Forest
6,758,763 B2 7/2004 Murphy et al.
6,773,359 B1 8/2004 Lee
6,773,360 B2 8/2004 Willett et al.
6,773,361 B1 8/2004 Lee
6,776,726 B2 8/2004 Sano
6,800,038 B2 10/2004 Willett et al.
6,800,040 B2 10/2004 Galloway et al.
6,805,643 B1 10/2004 Lin
6,808,460 B2 10/2004 Namiki
6,824,475 B2 11/2004 Burnett et al.
6,835,145 B2 12/2004 Tsurumaki
6,855,068 B2 2/2005 Antonious
6,860,818 B2 3/2005 Mahaffey et al.
6,860,823 B2 3/2005 Lee
6,860,824 B2 3/2005 Evans
6,875,124 B2 4/2005 Gilbert et al.
6,875,129 B2 4/2005 Erickson et al.
6,875,130 B2 4/2005 Nishio
6,881,158 B2 4/2005 Yang et al.
6,881,159 B2 4/2005 Galloway et al.
6,887,165 B2 5/2005 Tsurumaki
6,890,267 B2 5/2005 Mahaffey et al.
6,902,497 B2 6/2005 Deshmukh et al.
6,904,663 B2 6/2005 Willett et al.
6,923,734 B2 8/2005 Meyer
6,926,619 B2 8/2005 Helmstetter et al.
6,960,142 B2 11/2005 Bissonnette et al.
6,964,617 B2 11/2005 Williams
6,974,393 B2 12/2005 Caldwell et al.
6,988,960 B2 1/2006 Mahaffey et al.
6,991,558 B2 1/2006 Beach et al.
D515,165 S 2/2006 Zimmerman et al.
6,994,636 B2 2/2006 Hocknell et al.
6,997,820 B2 2/2006 Willett et al.
7,004,849 B2 2/2006 Cameron
7,004,852 B2 2/2006 Billings
7,025,692 B2 4/2006 Erickson et al.
7,029,403 B2 4/2006 Rice et al.
7,070,512 B2 7/2006 Nishio
7,070,517 B2 7/2006 Cackett et al.
7,077,762 B2 7/2006 Kouno et al.
7,097,572 B2 8/2006 Yabu
7,101,289 B2 9/2006 Gibbs et al.
7,137,906 B2 11/2006 Tsunoda et al.
7,137,907 B2 11/2006 Gibbs et al.
7,140,974 B2 11/2006 Chao et al.
7,144,334 B2 12/2006 Ehlers et al.
7,147,573 B2 12/2006 Dimarco
7,153,220 B2 12/2006 Lo
7,163,468 B2 1/2007 Gibbs et al.
7,163,470 B2 1/2007 Galloway et al.
7,166,038 B2 1/2007 Williams et al.
7,166,040 B2 1/2007 Hoffman et al.
7,166,041 B2 1/2007 Evans
7,169,058 B1 1/2007 Fagan
7,169,060 B2 1/2007 Stevens et al.
7,179,034 B2 2/2007 Ladouceur
7,186,190 B1 3/2007 Beach et al.
7,189,169 B2 3/2007 Billlings
7,198,575 B2 4/2007 Beach et al.
7,201,669 B2 4/2007 Stites et al.
D543,600 S 5/2007 Oldknow
7,211,005 B2 5/2007 Lindsay
7,214,143 B2 5/2007 Deshmukh
7,223,180 B2 5/2007 Willett et al.
D544,939 S 6/2007 Radcliffe et al.
7,252,600 B2 8/2007 Murphy et al.
7,255,654 B2 8/2007 Murphy et al.
7,267,620 B2 9/2007 Chao et al.
7,273,423 B2 9/2007 Imamoto
7,278,927 B2 10/2007 Gibbs et al.
7,281,985 B2 10/2007 Galloway
D554,720 S 11/2007 Barez et al.
7,291,074 B2 11/2007 Kouno et al.
7,294,064 B2 11/2007 Tsurumaki et al.
7,294,065 B2 11/2007 Liang et al.
7,303,488 B2 12/2007 Kakiuchi et al.
7,306,527 B2 12/2007 Williams et al.
7,354,353 B2 * 4/2008 Hocknell ..... A63B 53/0466 473/307
7,377,860 B2 5/2008 Breier et al.
7,390,266 B2 6/2008 Gwon
7,407,447 B2 8/2008 Beach et al.
7,419,441 B2 9/2008 Hoffman et al.
7,448,963 B2 11/2008 Beach et al.
7,500,924 B2 3/2009 Yokota
7,520,820 B2 4/2009 Dimarco
7,530,901 B2 5/2009 Imamoto et al.
7,530,904 B2 5/2009 Beach et al.
7,540,811 B2 6/2009 Beach et al.
7,563,175 B2 7/2009 Nishitani et al.
7,568,985 B2 8/2009 Beach et al.
7,572,193 B2 8/2009 Yokota
7,578,753 B2 8/2009 Beach et al.
7,582,024 B2 9/2009 Shear
7,591,737 B2 9/2009 Gibbs et al.
7,591,738 B2 9/2009 Beach et al.
7,621,823 B2 11/2009 Beach et al.
7,632,196 B2 * 12/2009 Reed ..... A63B 53/0466 473/324
8,206,244 B2 * 6/2012 Honea ..... A63B 53/00 473/345
8,357,058 B2 1/2013 Honea et al.
8,591,353 B1 * 11/2013 Honea ..... A63B 53/0466 473/345
9,168,431 B2 * 10/2015 Honea ..... A63B 53/00
10,058,747 B2 * 8/2018 Honea ..... A63B 53/00
10,625,125 B2 * 4/2020 Honea ..... A63B 53/0466
2001/0049310 A1 12/2001 Cheng et al.
2002/0022535 A1 2/2002 Takeda
2002/0032075 A1 3/2002 Vatsvog
2002/0055396 A1 5/2002 Nishimoto et al.
2002/0072434 A1 6/2002 Yabu
2002/0123394 A1 9/2002 Tsurumaki
2002/0137576 A1 9/2002 Dammen
2002/0160854 A1 10/2002 Beach et al.
2002/0183130 A1 12/2002 Pacinella
2003/0032500 A1 2/2003 Nakahara et al.
2003/0130059 A1 7/2003 Billings
2003/0220154 A1 11/2003 Anelli
2004/0087388 A1 5/2004 Beach et al.
2004/0157678 A1 8/2004 Kohno
2004/0176183 A1 9/2004 Tsurumaki
2004/0192463 A1 9/2004 Tsurumaki et al.
2004/0235584 A1 11/2004 Chao et al.
2004/0242343 A1 12/2004 Chao et al.
2005/0101404 A1 5/2005 Long et al.
2005/0137024 A1 6/2005 Stites et al.
2005/0181884 A1 8/2005 Beach et al.
2005/0239575 A1 10/2005 Chao et al.
2005/0239576 A1 10/2005 Stites et al.
2006/0009305 A1 1/2006 Lindsay
2006/0035722 A1 2/2006 Beach et al.
2006/0058112 A1 3/2006 Haralason et al.
2006/0094535 A1 5/2006 Cameron
2006/0122004 A1 6/2006 Chen et al.
2006/0154747 A1 7/2006 Beach
2006/0172821 A1 8/2006 Evans et al.
2006/0240908 A1 10/2006 Adams et al.
2006/0281581 A1 12/2006 Yamamoto
2007/0026961 A1 2/2007 Hou
2007/0049417 A1 3/2007 Shear
2007/0105646 A1 5/2007 Beach et al.
2007/0105647 A1 5/2007 Beach et al.
2007/0105648 A1 5/2007 Beach et al.
2007/0105649 A1 5/2007 Beach et al.
2007/0105650 A1 5/2007 Beach et al.

(56) References Cited

U.S. PATENT DOCUMENTS

| | | | | |
|---|---|---|---|---|
| 2007/0105651 | A1 | 5/2007 | Beach et al. | |
| 2007/0105652 | A1 | 5/2007 | Beach et al. | |
| 2007/0105653 | A1 | 5/2007 | Beach et al. | |
| 2007/0105654 | A1 | 5/2007 | Beach et al. | |
| 2007/0105655 | A1 | 5/2007 | Beach et al. | |
| 2007/0117652 | A1 | 5/2007 | Beach et al. | |
| 2007/0275792 | A1 | 11/2007 | Horacek et al. | |
| 2008/0146370 | A1 | 6/2008 | Beach et al. | |
| 2008/0161127 | A1 | 7/2008 | Yamamoto | |
| 2008/0254911 | A1 | 10/2008 | Beach et al. | |
| 2008/0261717 | A1 | 10/2008 | Hoffman et al. | |
| 2008/0280698 | A1 | 11/2008 | Hoffman et al. | |
| 2009/0088269 | A1 | 4/2009 | Beach et al. | |
| 2009/0088271 | A1 | 4/2009 | Beach et al. | |
| 2009/0137338 | A1 | 5/2009 | Kajita | |
| 2009/0170632 | A1 | 7/2009 | Beach et al. | |
| 2009/0181789 | A1 | 7/2009 | Reed et al. | |
| 2010/0048316 | A1 | 2/2010 | Honea et al. | |
| 2012/0225735 | A1 | 9/2012 | Honea et al. | |
| 2017/0291079 | A1* | 10/2017 | Honea ..... | A63B 53/0466 |

FOREIGN PATENT DOCUMENTS

| | | | |
|---|---|---|---|
| EP | 0470488 | | 3/1995 |
| EP | 0617987 | | 11/1997 |
| EP | 1001175 | | 5/2000 |
| GB | 194823 | | 12/1921 |
| JP | 03049777 | A | 3/1991 |
| JP | 03151988 | A | 6/1991 |
| JP | 4180778 | | 6/1992 |
| JP | 05317465 | | 12/1993 |
| JP | 06126004 | | 5/1994 |
| JP | 06182004 | A | 7/1994 |
| JP | 06238022 | | 8/1994 |
| JP | 06285186 | A | 10/1994 |
| JP | 6304271 | | 11/1994 |
| JP | 08117365 | A | 5/1996 |
| JP | 09028844 | | 2/1997 |
| JP | 09308717 | | 12/1997 |
| JP | 09327534 | | 12/1997 |
| JP | 2773009 | | 7/1998 |
| JP | 10234902 | | 9/1998 |
| JP | 10277187 | | 10/1998 |
| JP | 2000014841 | | 1/2000 |
| JP | 2000167089 | A | 6/2000 |
| JP | 2000288131 | A | 10/2000 |
| JP | 2000300701 | A | 10/2000 |
| JP | 2000342721 | A | 12/2000 |
| JP | 2001054595 | | 2/2001 |
| JP | 2001170225 | | 6/2001 |
| JP | 2001204856 | | 7/2001 |
| JP | 2001231888 | A | 8/2001 |
| JP | 2001346918 | | 12/2001 |
| JP | 2002003969 | | 1/2002 |
| JP | 2002017910 | | 1/2002 |
| JP | 2002052099 | | 2/2002 |
| JP | 2002248183 | | 9/2002 |
| JP | 2002253706 | | 9/2002 |
| JP | 2003038691 | | 2/2003 |
| JP | 2003126311 | | 5/2003 |
| JP | 2003226952 | | 8/2003 |
| JP | 2004174224 | | 6/2004 |
| JP | 2004183058 | | 7/2004 |
| JP | 2004222911 | | 8/2004 |
| JP | 2004267438 | | 9/2004 |
| JP | 2005028170 | | 2/2005 |
| JP | 05296582 | | 10/2005 |
| JP | 05323978 | | 11/2005 |
| JP | 2006320493 | | 11/2006 |
| JP | 4128970 | | 7/2008 |
| JP | 2009000281 | | 1/2009 |
| WO | WO8802642 | | 4/1988 |
| WO | WO0166199 | | 9/2001 |
| WO | WO02062501 | | 8/2002 |
| WO | WO03061773 | | 7/2003 |
| WO | WO2004043549 | | 5/2004 |

OTHER PUBLICATIONS

Mike Stachura, "The Hot List", Golf Digest Magazine, Feb. 2005, pp. 120-130.
Mike Stachura, "The Hot List", Golf Digest Magazine, Feb. 2005, pp. 131-143.
Mike Stachura, "The Hot List", Golf Digest Magazine, Feb. 2006, pp. 122-132.
Mike Stachura, "The Hot List", Golf Digest Magazine, Feb. 2006, pp. 133-143.
Mike Stachura, "The Hot List", Golf Digest Magazine, Feb. 2007, pp. 130-151.
"The Hot List", Golf Digest Magazine, Feb. 2008, pp. 114-139.
"The Hot List", Golf Digest Magazine, Feb. 2009, pp. 101-127.
Callaway Golf, World's Straightest Driver: FT-i Driver downloaded from www.callawaygolf.com/ft%2Di/driver.aspx?lang=en on Apr. 5, 2007.
Jackson,Jeff, The Modern Guide to Golf Clubmaking, Ohio: Dynacraft Golf Products, Inc., copyright 1994, p. 237.
Nike Golf, Sasquatch 460, downloaded from www.nike.com/nikegolf/index.htm on Apr. 5, 2007.
Mike Golf, Sasquatch Sumo Squared Driver, downloaded from www.nike.com/nikegolf/index.htm on Apr. 5, 2007.
Taylor Made Golf Company, Inc. Press Release, Burner Fairway Wood, www.tmag.com/media/pressreleases/2007/011807_burner_fairway_rescue.html, Jan. 26, 2007.
Taylor Made Golf Company Inc., R7 460 Drivers, downloaded from www.taylormadegolf.com/product_detail.asp?pID=14section=overview on Apr. 5, 2007.
Titleist 907D1, downloaded from www.tees2greens.com/forum/Uploads/Images/7ade3521-192b-4611-870b-395d.jpg on Feb. 1, 2007.

* cited by examiner

Conventional F.W.
(Prior Art)

Oversized F.W.
(Prior Art)

| PRIOR ART MEASURED DATA | Prior Art Product A | Prior Art Product B | Prior Art Product C | Prior Art Product D | Prior Art Product E | Prior Art Product F | Prior Art Product G | Prior Art Product H | Prior Art Product I | Prior Art Product J | Prior Art Product K | Prior Art Product L | Prior Art Product M | Prior Art Product N | Prior Art Product O | Prior Art Product P | Prior Art Product Q | Prior Art Product R | Prior Art Product S | Prior Art Product T | Average |
|---|---|---|---|---|---|---|---|---|---|---|---|---|---|---|---|---|---|---|---|---|---|
| MOIy | 2118 | 2876 | 2427 | 1868 | 2502 | 2368 | 2652 | 2688 | 2698 | 3001 | 2729 | 2695 | 2961 | 2428 | 2268 | 2528 | 2672 | 3181 | 2400 | 2532 | 2589 |
| Club Moment Arm (CMA) | 1.076 | 1.116 | 1.024 | 1.068 | 1.016 | 1.129 | 1.160 | 1.210 | 0.827 | 1.071 | 1.114 | 0.941 | 1.202 | 0.969 | 0.926 | 0.926 | 0.968 | 1.293 | 1.001 | 1.186 | 1.062 |
| "Abl" Dimension | 0.759 | 0.921 | 0.760 | 0.744 | 0.911 | 0.931 | 0.886 | 0.871 | 0.863 | 1.002 | 0.893 | 0.848 | 0.850 | 0.900 | 1.057 | 1.076 | 1.071 | 1.098 | 0.860 | 1.017 | 0.918 |
| Blade Length (BL) | 2.800 | 3.204 | 2.912 | 2.822 | 2.993 | 2.823 | 2.874 | 2.844 | 2.838 | 3.110 | 3.028 | 3.042 | 3.192 | 2.938 | 2.999 | 3.181 | 3.095 | 3.294 | 2.898 | 3.167 | 3.003 |

*Fig. 30*

| PRIOR ART MEASURED DATA | Prior Art Product A | Prior Art Product B | Prior Art Product C | Prior Art Product D | Prior Art Product E | Prior Art Product F | Prior Art Product G | Prior Art Product H | Prior Art Product I | Prior Art Product J | Prior Art Product K | Prior Art Product L | Prior Art Product M | Prior Art Product N | Prior Art Product O | Prior Art Product P | Prior Art Product Q | Prior Art Product R | Prior Art Product S | Prior Art Product T | Average |
|---|---|---|---|---|---|---|---|---|---|---|---|---|---|---|---|---|---|---|---|---|---|
| MOIy | 2118 | 2676 | 2427 | 1868 | 2502 | 2368 | 2662 | 2686 | 2698 | 3001 | 2729 | 2695 | 2961 | 2428 | 2268 | 2528 | 2672 | 3181 | 2400 | 2632 | 2589 |
| Club Moment Arm (CMA) | 1.076 | 1.116 | 1.024 | 1.068 | 1.016 | 1.129 | 1.160 | 1.210 | 0.627 | 1.071 | 1.114 | 0.941 | 1.202 | 0.969 | 0.926 | 0.928 | 0.988 | 1.293 | 1.001 | 1.186 | 1.062 |
| "Abl" Dimension | 0.759 | 0.921 | 0.780 | 0.744 | 0.911 | 0.931 | 0.888 | 0.871 | 0.863 | 1.002 | 0.893 | 0.848 | 0.850 | 0.900 | 1.057 | 1.076 | 1.071 | 1.098 | 0.880 | 1.017 | 0.918 |
| Blade Length (BL) | 2.800 | 3.204 | 2.912 | 2.822 | 2.993 | 2.823 | 2.874 | 2.844 | 2.838 | 3.110 | 3.028 | 3.042 | 3.192 | 2.939 | 2.999 | 3.181 | 3.095 | 3.294 | 2.898 | 3.167 | 3.003 |
| Front to Back Dim (FB) | 3.062 | 3.373 | 3.092 | 3.064 | 2.886 | 3.162 | 3.154 | 3.401 | 3.314 | 3.290 | 3.214 | 3.288 | 3.550 | 3.001 | 3.020 | 3.125 | 3.058 | 3.477 | 3.130 | 3.079 | 3.187 |
| (FB) / (BL) | 1.094 | 1.053 | 1.062 | 1.085 | 0.966 | 1.120 | 1.097 | 1.196 | 1.168 | 1.058 | 1.061 | 1.081 | 1.112 | 1.021 | 1.007 | 0.982 | 0.991 | 1.055 | 1.080 | 0.972 | 1.063 |

*Fig. 31*

| PRIOR ART MEASURED DATA | Prior Art Product A | Prior Art Product B | Prior Art Product C | Prior Art Product D | Prior Art Product E | Prior Art Product F | Prior Art Product G | Prior Art Product H | Prior Art Product I | Prior Art Product J | Prior Art Product K | Prior Art Product L | Prior Art Product M | Prior Art Product N | Prior Art Product O | Prior Art Product P | Prior Art Product Q | Prior Art Product R | Prior Art Product S | Prior Art Product T | Average |
|---|---|---|---|---|---|---|---|---|---|---|---|---|---|---|---|---|---|---|---|---|---|
| MOIy | 2118 | 2876 | 2427 | 1868 | 2502 | 2368 | 2652 | 2886 | 2698 | 3001 | 2729 | 2695 | 2961 | 2428 | 2268 | 2528 | 2672 | 3181 | 2400 | 2532 | 2589 |
| Club Moment Arm (CMA) | 1.076 | 1.116 | 1.024 | 1.068 | 1.016 | 1.129 | 1.160 | 1.210 | 0.827 | 1.071 | 1.114 | 0.941 | 1.202 | 0.969 | 0.926 | 0.928 | 0.986 | 1.293 | 1.001 | 1.166 | 1.062 |
| "Abl" Dimension | 0.759 | 0.921 | 0.780 | 0.744 | 0.911 | 0.931 | 0.888 | 0.871 | 0.863 | 1.002 | 0.893 | 0.848 | 0.850 | 0.900 | 1.057 | 1.076 | 1.071 | 1.098 | 0.880 | 1.017 | 0.918 |
| Blade Length (BL) | 2.800 | 3.204 | 2.912 | 2.822 | 2.993 | 2.823 | 2.874 | 2.844 | 2.838 | 3.110 | 3.028 | 3.042 | 3.192 | 2.938 | 2.999 | 3.181 | 3.095 | 3.294 | 2.898 | 3.167 | 3.003 |
| Front to Back Dim (FB) | 3.062 | 3.373 | 3.092 | 3.064 | 2.888 | 3.162 | 3.154 | 3.401 | 3.314 | 3.290 | 3.214 | 3.288 | 3.550 | 3.001 | 3.020 | 3.125 | 3.068 | 3.477 | 3.130 | 3.079 | 3.187 |
| (Abl) / (FB) | 0.248 | 0.273 | 0.252 | 0.243 | 0.316 | 0.294 | 0.282 | 0.256 | 0.260 | 0.305 | 0.278 | 0.258 | 0.240 | 0.300 | 0.350 | 0.344 | 0.349 | 0.316 | 0.281 | 0.330 | 0.289 |
| Face Closing MOI (MOIfc) | 3321 | 4353 | 3638 | 2932 | 4136 | 3637 | 3937 | 4391 | 4999 | 4433 | 4762 | 4012 | 4947 | 3702 | 3991 | 4288 | 4162 | 5509 | 3738 | 4671 | 4178 |

*Fig. 32*

| PRIOR ART MEASURED DATA | Prior Art Product A | Prior Art Product B | Prior Art Product C | Prior Art Product D | Prior Art Product E | Prior Art Product F | Prior Art Product G | Prior Art Product H | Prior Art Product I | Prior Art Product J | Prior Art Product K | Prior Art Product L | Prior Art Product M | Prior Art Product N | Prior Art Product O | Prior Art Product P | Prior Art Product Q | Prior Art Product R | Prior Art Product S | Prior Art Product T | Average |
|---|---|---|---|---|---|---|---|---|---|---|---|---|---|---|---|---|---|---|---|---|---|
| MOly | 2118 | 2876 | 2427 | 1868 | 2502 | 2368 | 2652 | 2886 | 2698 | 3001 | 2729 | 2695 | 2951 | 2428 | 2268 | 2528 | 2672 | 3181 | 2400 | 2532 | 2589 |
| Club Moment Arm (CMA) | 1.075 | 1.115 | 1.024 | 1.066 | 1.018 | 1.129 | 1.160 | 1.210 | 0.827 | 1.071 | 1.114 | 0.941 | 1.202 | 0.969 | 0.926 | 0.928 | 0.968 | 1.293 | 1.001 | 1.186 | 1.062 |
| "Abl" Dimension | 0.759 | 0.921 | 0.780 | 0.744 | 0.911 | 0.931 | 0.888 | 0.871 | 0.863 | 1.002 | 0.893 | 0.848 | 0.850 | 0.900 | 1.057 | 1.076 | 1.071 | 1.098 | 0.880 | 1.017 | 0.918 |
| Blade Length (BL) | 2.800 | 3.204 | 2.912 | 2.822 | 2.993 | 2.823 | 2.874 | 2.844 | 2.838 | 3.110 | 3.028 | 3.042 | 3.192 | 2.938 | 2.999 | 3.181 | 3.095 | 3.294 | 2.898 | 3.167 | 3.003 |
| Xcg | 0.827 | 0.897 | 0.802 | 0.784 | 0.984 | 0.813 | 0.813 | 0.851 | 0.893 | 0.926 | 1.045 | 0.811 | 0.962 | 0.875 | 0.987 | 1.035 | 0.933 | 1.074 | 0.877 | 1.114 | 0.915 |
| Ycg | 0.670 | 0.638 | 0.634 | 0.629 | 0.597 | 0.677 | 0.741 | 0.680 | 0.605 | 0.683 | 0.690 | 0.774 | 0.706 | 0.661 | 0.612 | 0.676 | 0.728 | 0.600 | 0.642 | 0.612 | 0.663 |
| Zcg | 0.452 | 0.539 | 0.495 | 0.435 | 0.483 | 0.503 | 0.514 | 0.600 | 0.940 | 0.439 | 0.602 | 0.554 | 0.726 | 0.392 | 0.512 | 0.468 | 0.468 | 0.709 | 0.476 | 0.586 | 0.545 |
| CG angle (CGA) | 28.7 | 31.0 | 31.7 | 29.1 | 26.2 | 31.7 | 32.3 | 35.2 | 46.5 | 25.4 | 29.9 | 34.3 | 37.0 | 24.1 | 27.4 | 24.3 | 26.7 | 33.4 | 28.5 | 27.7 | 30.8 |

*Fig. 33*

| PRIOR ART MEASURED DATA | Prior Art Product A | Prior Art Product B | Prior Art Product C | Prior Art Product D | Prior Art Product E | Prior Art Product F | Prior Art Product G | Prior Art Product H | Prior Art Product I | Prior Art Product J | Prior Art Product K | Prior Art Product L | Prior Art Product M | Prior Art Product N | Prior Art Product O | Prior Art Product P | Prior Art Product Q | Prior Art Product R | Prior Art Product S | Prior Art Product T | Average |
|---|---|---|---|---|---|---|---|---|---|---|---|---|---|---|---|---|---|---|---|---|---|
| MOIy | 2118 | 2876 | 2427 | 1868 | 2502 | 2368 | 2652 | 2886 | 2698 | 3001 | 2729 | 2695 | 2961 | 2428 | 2268 | 2526 | 2672 | 3181 | 2400 | 2532 | 2589 |
| | | | | | | | | | | | | | | | | | | | | | |
| Club Moment Arm (CMA) | 1.076 | 1.116 | 1.024 | 1.068 | 1.016 | 1.129 | 1.160 | 1.210 | 0.827 | 1.071 | 1.114 | 0.941 | 1.202 | 0.969 | 0.926 | 0.928 | 0.988 | 1.293 | 1.001 | 1.186 | 1.062 |
| | | | | | | | | | | | | | | | | | | | | | |
| "Abl" Dimension | 0.759 | 0.921 | 0.760 | 0.744 | 0.911 | 0.931 | 0.868 | 0.871 | 0.863 | 1.002 | 0.893 | 0.848 | 0.850 | 0.900 | 1.057 | 1.076 | 1.071 | 1.096 | 0.680 | 1.017 | 0.918 |
| Blade Length (BL) | 2.800 | 3.204 | 2.912 | 2.822 | 2.993 | 2.823 | 2.874 | 2.644 | 2.838 | 3.110 | 3.028 | 3.042 | 3.192 | 2.938 | 2.999 | 3.181 | 3.095 | 3.294 | 2.698 | 3.167 | 3.003 |
| | | | | | | | | | | | | | | | | | | | | | |
| (CMA)/(Abl) | 1.417 | 1.212 | 1.312 | 1.434 | 1.114 | 1.214 | 1.306 | 1.389 | 0.958 | 1.069 | 1.247 | 1.110 | 1.414 | 1.076 | 0.876 | 0.863 | 0.923 | 1.177 | 1.137 | 1.166 | 1.157 |

*Fig. 34*

| PRIOR ART MEASURED DATA | Prior Art Product A | Prior Art Product B | Prior Art Product C | Prior Art Product D | Prior Art Product E | Prior Art Product F | Prior Art Product G | Prior Art Product H | Prior Art Product I | Prior Art Product J | Prior Art Product K | Prior Art Product L | Prior Art Product M | Prior Art Product N | Prior Art Product O | Prior Art Product P | Prior Art Product Q | Prior Art Product R | Prior Art Product S | Prior Art Product T | Average |
|---|---|---|---|---|---|---|---|---|---|---|---|---|---|---|---|---|---|---|---|---|---|
| MOIy | 2118 | 2876 | 2427 | 1868 | 2502 | 2368 | 2652 | 2886 | 2898 | 3001 | 2729 | 2695 | 2961 | 2428 | 2268 | 2528 | 2672 | 3181 | 2400 | 2532 | 2589 |
| | | | | | | | | | | | | | | | | | | | | | |
| Club Moment Arm (CMA) | 1.076 | 1.116 | 1.024 | 1.068 | 1.016 | 1.129 | 1.160 | 1.210 | 0.827 | 1.071 | 1.114 | 0.941 | 1.202 | 0.969 | 0.926 | 0.928 | 0.988 | 1.293 | 1.001 | 1.186 | 1.062 |
| | | | | | | | | | | | | | | | | | | | | | |
| "Abl" Dimension | 0.759 | 0.921 | 0.780 | 0.744 | 0.911 | 0.931 | 0.888 | 0.871 | 0.863 | 1.002 | 0.893 | 0.848 | 0.850 | 0.900 | 1.057 | 1.076 | 1.071 | 1.098 | 0.880 | 1.017 | 0.918 |
| Blade Length (BL) | 2.800 | 3.204 | 2.912 | 2.822 | 2.993 | 2.823 | 2.874 | 2.844 | 2.838 | 3.110 | 3.028 | 3.042 | 3.192 | 2.938 | 2.999 | 3.181 | 3.095 | 3.294 | 2.896 | 3.167 | 3.003 |
| | | | | | | | | | | | | | | | | | | | | | |
| (Abl)/(BL) | 0.271 | 0.288 | 0.268 | 0.264 | 0.304 | 0.330 | 0.309 | 0.306 | 0.304 | 0.322 | 0.295 | 0.279 | 0.266 | 0.306 | 0.352 | 0.338 | 0.346 | 0.333 | 0.304 | 0.321 | 0.306 |
| | | | | | | | | | | | | | | | | | | | | | |

*Fig. 35*

| PRIOR ART MEASURED DATA | Prior Art Product A | Prior Art Product B | Prior Art Product C | Prior Art Product D | Prior Art Product E | Prior Art Product F | Prior Art Product G | Prior Art Product H | Prior Art Product I | Prior Art Product J | Prior Art Product K | Prior Art Product L | Prior Art Product M | Prior Art Product N | Prior Art Product O | Prior Art Product P | Prior Art Product Q | Prior Art Product R | Prior Art Product S | Prior Art Product T | Average |
|---|---|---|---|---|---|---|---|---|---|---|---|---|---|---|---|---|---|---|---|---|---|
| MOIy | 2118 | 2876 | 2427 | 1866 | 2502 | 2368 | 2652 | 2686 | 2698 | 3001 | 2729 | 2695 | 2961 | 2428 | 2268 | 2528 | 2672 | 3181 | 2400 | 2532 | 2589 |
| Xcg | 0.827 | 0.897 | 0.802 | 0.784 | 0.984 | 0.813 | 0.813 | 0.851 | 0.893 | 0.926 | 1.045 | 0.811 | 0.962 | 0.876 | 0.987 | 1.035 | 0.933 | 1.074 | 0.877 | 1.114 | 0.915 |
| Ycg | 0.670 | 0.638 | 0.634 | 0.629 | 0.597 | 0.677 | 0.741 | 0.680 | 0.605 | 0.683 | 0.690 | 0.774 | 0.706 | 0.661 | 0.612 | 0.676 | 0.728 | 0.600 | 0.642 | 0.612 | 0.683 |
| Zcg | 0.452 | 0.539 | 0.495 | 0.435 | 0.483 | 0.503 | 0.514 | 0.600 | 0.940 | 0.439 | 0.602 | 0.554 | 0.726 | 0.392 | 0.512 | 0.468 | 0.468 | 0.709 | 0.476 | 0.586 | 0.545 |
| | | | | | | | | | | | | | | | | | | | | | |
| Club Moment Arm (Center) | 1.076 | 1.116 | 1.024 | 1.068 | 1.016 | 1.129 | 1.160 | 1.210 | 0.827 | 1.071 | 1.114 | 0.941 | 1.202 | 0.969 | 0.926 | 0.928 | 0.988 | 1.293 | 1.001 | 1.186 | 1.062 |
| | | | | | | | | | | | | | | | | | | | | | |
| "Abl" Dimension | 0.759 | 0.921 | 0.780 | 0.744 | 0.911 | 0.931 | 0.888 | 0.871 | 0.863 | 1.002 | 0.893 | 0.848 | 0.850 | 0.900 | 1.057 | 1.076 | 1.071 | 1.098 | 0.880 | 1.017 | 0.918 |
| Blade Length (BL) | 2.800 | 3.204 | 2.912 | 2.822 | 2.993 | 2.823 | 2.874 | 2.844 | 2.838 | 3.110 | 3.028 | 3.042 | 3.192 | 2.936 | 2.999 | 3.181 | 3.095 | 3.294 | 2.898 | 3.167 | 3.003 |
| | | | | | | | | | | | | | | | | | | | | | |
| Tranfer Distance (TD) | 0.942 | 1.047 | 0.942 | 0.897 | 1.096 | 0.956 | 0.961 | 1.042 | 1.297 | 1.024 | 1.206 | 0.982 | 1.305 | 0.959 | 1.112 | 1.136 | 1.043 | 1.287 | 0.998 | 1.259 | 1.070 |
| | | | | | | | | | | | | | | | | | | | | | |
| Club Head Mass (grams) | 209.9 | 208.9 | 211.5 | 205.2 | 210.6 | 215.3 | 215.4 | 215 | 212 | 211.5 | 216.7 | 211.6 | 211.9 | 214.9 | 216 | 211.5 | 212.2 | 217.8 | 208.3 | 209.2 | 212.3 |
| | | | | | | | | | | | | | | | | | | | | | |
| Face Closing MOI (MOIfc) | 3321 | 4353 | 3638 | 2932 | 4136 | 3637 | 3937 | 4391 | 4999 | 4433 | 4762 | 4012 | 4947 | 3702 | 3991 | 4288 | 4162 | 5509 | 3738 | 4671 | 4176 |

*Fig. 36*

GOLF CLUB

CROSS-REFERENCE TO RELATED APPLICATIONS

This application is a continuation of U.S. patent application Ser. No. 16/853,159, filed on Apr. 20, 2020, which is a continuation of U.S. patent application Ser. No. 16/458,916, filed on Jul. 1, 2019, now U.S. Pat. No. 10,625,125, which is a continuation of U.S. patent application No. 16,108,299, filed on Aug. 22, 2018, now U.S. Pat. No. 10,335,649 which is a continuation of U.S. patent application Ser. No. 15/632,417, filed on Jun. 26, 2017, now U.S. Pat. No. 10,058,747, which is a continuation of U.S. patent application Ser. No. 14/865,379, filed on Sep. 25, 2015, now U.S. Pat. No. 9,687,700, which is a continuation of U.S. patent application Ser. No. 14/060,948, filed on Oct. 23, 2013, now U.S. Pat. No. 9,168,431, which is a continuation of U.S. patent application Ser. No. 13/716,437, filed on Dec. 17, 2012, now U.S. Pat. No. 8,591,353, which is a continuation of U.S. patent application Ser. No. 13/476,321, filed on May 21, 2012, now U.S. Pat. No. 8,357,058, which is a continuation of U.S. patent application Ser. No. 12/609,209, filed on Oct. 30, 2009, now U.S. Pat. No. 8,206,244, which is a continuation-in-part of U.S. patent application Ser. No. 11/972,368, filed Jan. 10, 2008, now U.S. Pat. No. 7,632,196, the content of which is hereby incorporated by reference as if completely written herein.

STATEMENT REGARDING FEDERALLY SPONSORED RESEARCH OR DEVELOPMENT

This invention was not made as part of a federally sponsored research or development project.

TECHNICAL FIELD

The present invention relates to the field of golf clubs, namely fairway wood type golf clubs. The present invention is a fairway wood type golf club characterized by a long blade length with a long heel blade length section, while having a small club moment arm and very low center of gravity.

BACKGROUND OF THE INVENTION

Fairway wood type golf clubs are unique in that they are essential to a golfer's course management, yet fairway woods have been left behind from a technological perspective compared to many of the other golf clubs in a golfer's bag. For instance, driver golf clubs have made tremendous technological advances in recent years; as have iron golf clubs, especially with the incorporation of more hybrid long irons into golf club sets.

Majority of the recent advances in these golf clubs have focused on positioning the center of gravity of the golf club head as low as possible and as far toward the rear of the golf club head as possible, along with attempting to increase the moment of inertia of the golf club head to reduce club head twisting at impact due to shots hit toward the toe or heel of the club head. Several unintended consequences came along with the benefits associated with these advances. The present invention is directed at addressing several of the unintended consequences in the field of fairway wood type golf clubs.

SUMMARY OF INVENTION

In its most general configuration, the present invention advances the state of the art with a variety of new capabilities and overcomes many of the shortcomings of prior methods in new and novel ways. In its most general sense, the present invention overcomes the shortcomings and limitations of the prior art in any of a number of generally effective configurations.

The present invention is a unique fairway wood type golf club. The club is a fairway wood type golf club characterized by a long blade length with a long heel blade length section, while having a small club moment arm and unique weight distribution, and all the benefits afforded therefrom. The fairway wood incorporates the discovery of unique relationships among key club head engineering variables that are inconsistent with merely striving to obtain a high MOIy using conventional golf club head design wisdom. The resulting fairway wood has a face closing moment of inertia (MOIfc) more closely matched with modern drivers and long hybrid iron golf clubs, allowing golfers to have a similar feel whether swinging a modern driver, the present fairway wood, or a modern hybrid golf club.

Numerous variations, modifications, alternatives, and alterations of the various preferred embodiments, processes, and methods may be used alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

FIG. 30 shows a table of data for currently available prior art fairway wood type golf club heads;

FIG. 31 shows a table of data for currently available prior art fairway wood type golf club heads;

FIG. 32 shows a table of data for currently available prior art fairway wood type golf club heads;

FIG. 33 shows a table of data for currently available prior art fairway wood type golf club heads;

FIG. 34 shows a table of data for currently available prior art fairway wood type golf club heads;

FIG. 35 shows a table of data for currently available prior art fairway wood type golf club heads;

FIG. 36 shows a table of data for currently available prior art fairway wood type golf club heads.

DETAILED DESCRIPTION OF THE INVENTION

The fairway wood type golf club of the present invention enables a significant advance in the state of the art. The preferred embodiments of the invention accomplish this by new and novel methods that are configured in unique and novel ways and which demonstrate previously unavailable, but preferred and desirable capabilities. The description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

In order to fully appreciate the present invention some common terms must be defined for use herein. First, one of skill in the art will know the meaning of "center of gravity," referred to herein as CG, from an entry level course on the mechanics of solids. With respect to wood-type golf clubs, which are generally hollow and/or having non-uniform density, the CG is often thought of as the intersection of all the balance points of the club head. In other words, if you balance the head on the face and then on the sole, the intersection of the two imaginary lines passing straight through the balance points would define the point referred to as the CG.

Figure 1:
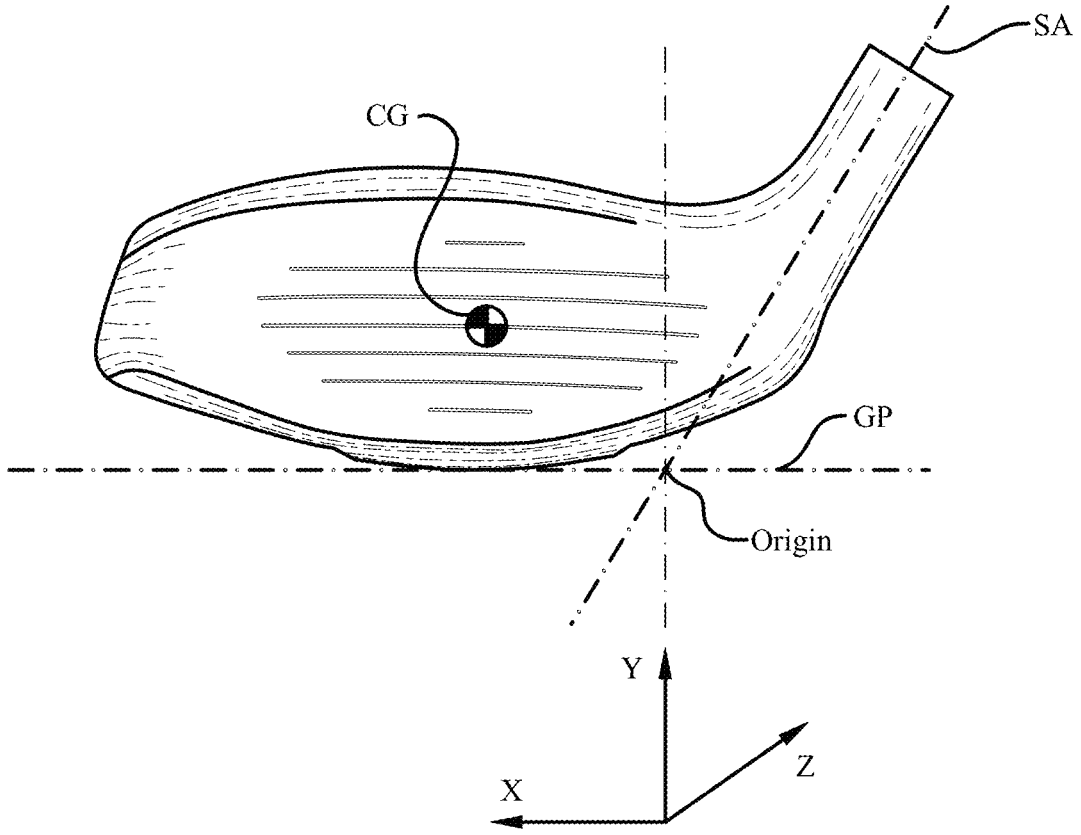
FIG. 1 shows a front elevation view of an embodiment of the present invention, not to scale.

It is helpful to establish a coordinate system to identify and discuss the location of the CG. In order to establish this coordinate system one must first identify a ground plane (GP) and a shaft axis (SA). First, the ground plane (GP) is the horizontal plane upon which a golf club head rests, as seen best in a front elevation view of a golf club head looking at the face of the golf club head, as seen in FIG. 1. Secondly, the shaft axis (SA) is the axis of a bore in the golf club head that is designed to receive a shaft. Some golf club heads have an external hosel that contains a bore for receiving the shaft such that one skilled in the art can easily appreciate the shaft axis (SA), while other "hosel-less" golf clubs have an internal bore that receives the shaft that nonetheless defines the shaft axis (SA). The shaft axis (SA) is fixed by the design of the golf club head and is also illustrated in FIG. 1.

Now, the intersection of the shaft axis (SA) with the ground plane (GP) fixes an origin point, labeled "origin" in FIG. 1, for the coordinate system. While it is common knowledge in the industry, it is worth noting that the right side of the club head seen in FIG. 1 is the side nearest the bore in which the shaft attaches is the "heel" side of the golf club head; and the opposite side, the left side in FIG. 1, is referred to as the "toe" side of the golf club head. Additionally, the portion of the golf club head that actually strikes a golf ball is referred to as the face of the golf club head and is commonly referred to as the front of the golf club head; whereas the opposite end of the golf club head is referred to as the rear of the golf club head and/or the trailing edge.

A three dimensional coordinate system may now be established from the origin with the Y-direction being the vertical direction from the origin; the X-direction being the horizontal direction perpendicular to the Y-direction and wherein the X-direction is parallel to the face of the golf club head in the natural resting position, also known as the design position; and the Z-direction is perpendicular to the X-direction wherein the Z-direction is the direction toward the rear of the golf club head. The X, Y, and Z directions are noted on a coordinate system symbol in FIG. 1. It should be noted that this coordinate system is contrary to the traditional right-hand rule coordinate system; however it is preferred so that the center of gravity may be referred to as having all positive coordinates.

Figure 2:
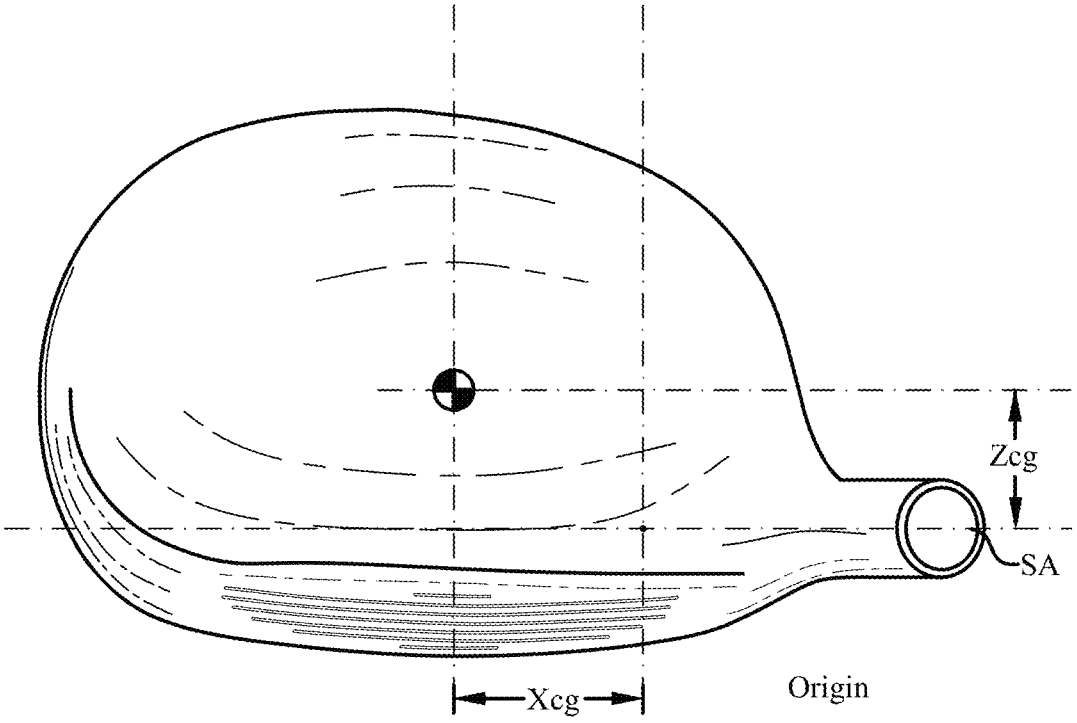
FIG. 2 shows a top plan view of an embodiment of the present invention, not to scale.
Figure 3:
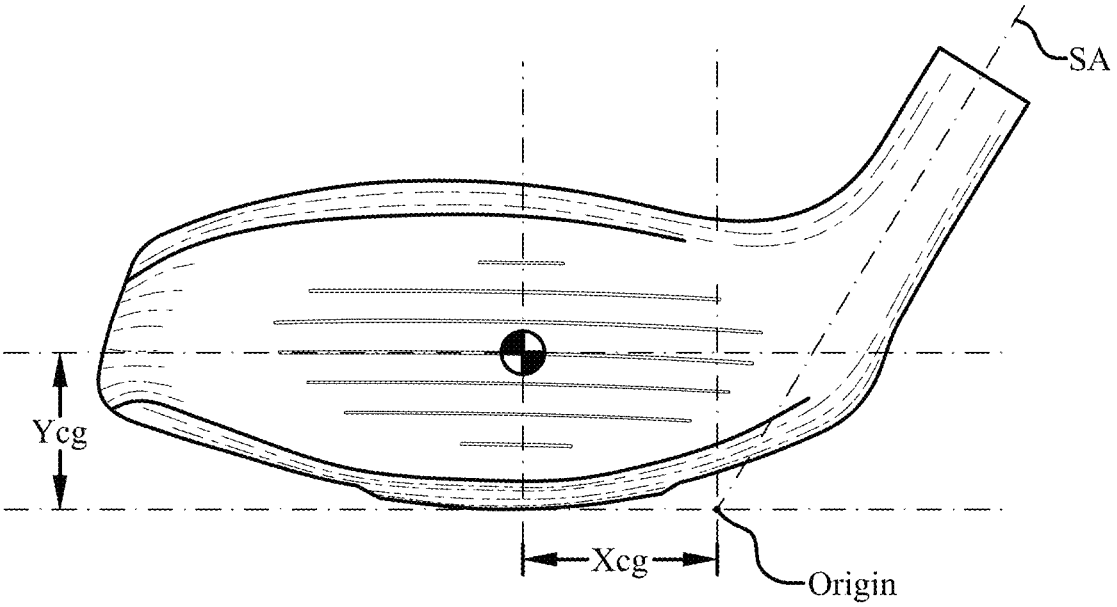
FIG. 3 shows a front elevation view of an embodiment of the present invention, not to scale.

Now, with the origin and coordinate system defined, the terms that define the location of the CG may be explained. One skilled in the art will appreciate that the CG of a hollow golf club head such as the wood-type golf club head illustrated in FIG. 2 will be behind the face of the golf club head. The distance behind the origin that the CG is located is referred to as Zcg, as seen in FIG. 2. Similarly, the distance above the origin that the CG is located is referred to as Ycg, as seen in FIG. 3. Lastly, the horizontal distance from the origin that the CG is located is referred to as Xcg, also seen in FIG. 3. Therefore, the location of the CG may be easily identified by reference to Xcg, Ycg, and Zcg.

Figure 4:
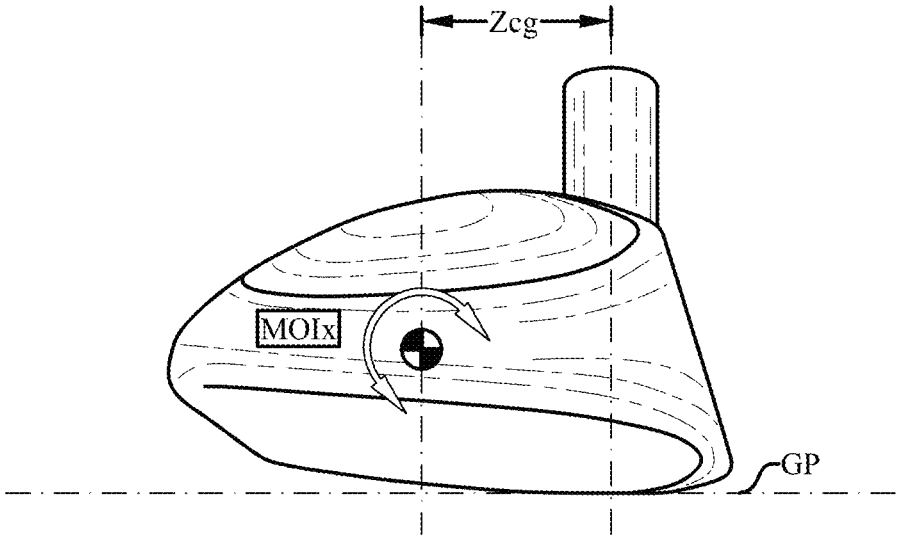
FIG. 4 shows a toe side elevation view of an embodiment of the present invention, not to scale.
Figure 5:
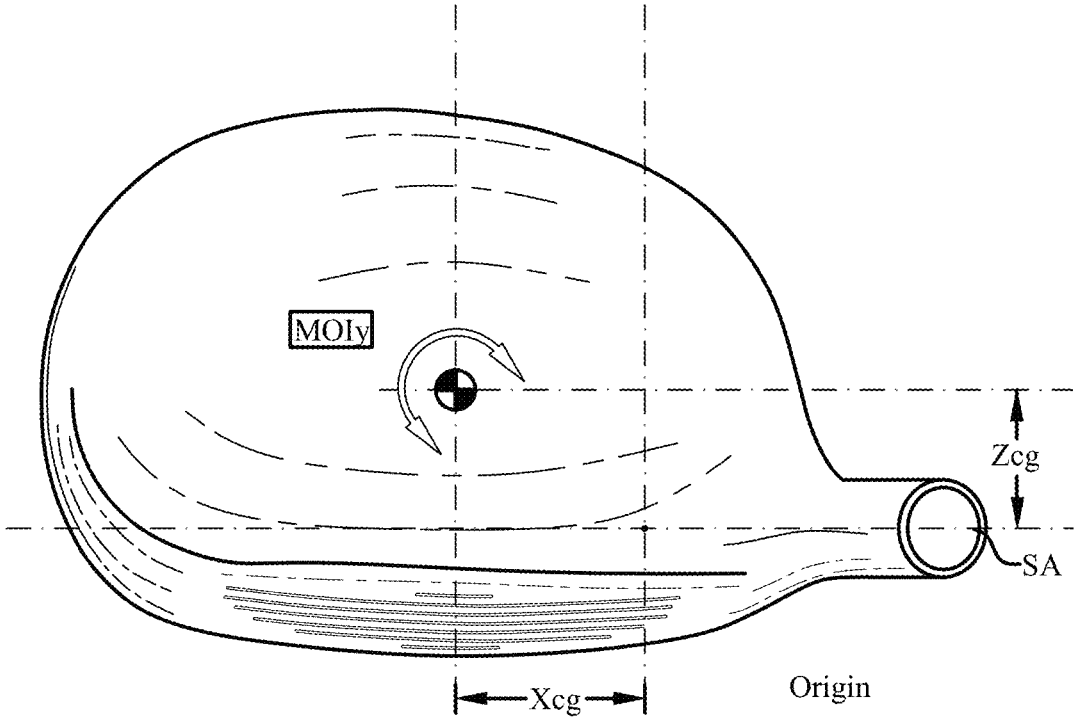
FIG. 5 shows a top plan view of an embodiment of the present invention, not to scale.

The moment of inertia of the golf club head is a key ingredient in the playability of the club. Again, one skilled in the art will understand what is meant by moment of inertia with respect of golf club heads; however it is helpful to define two moment of inertia components that will be commonly referred to herein. First, MOIx is the moment of inertia of the golf club head around an axis through the CG, parallel to the X-axis, labeled in FIG. 4. MOIx is the moment of inertia of the golf club head that resists lofting and delofting moments induced by ball strikes high or low on the face. Secondly, MOIy is the moment of the inertia of the golf club head around an axis through the CG, parallel to the Y-axis, labeled in FIG. 5. MOIy is the moment of inertia of the golf club head that resists opening and closing moments induced by ball strikes towards the toe side or heel side of the face.

Figure 6:
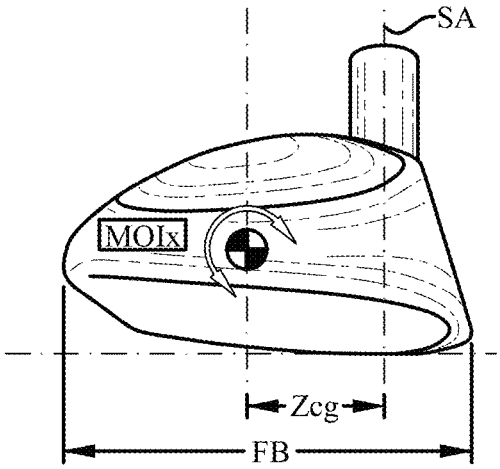
FIG. 6 shows a toe side elevation view of an embodiment of the present invention, not to scale.
Figure 7:
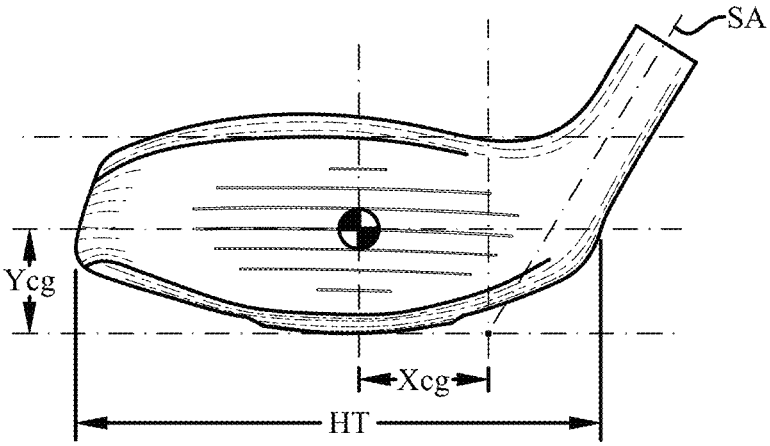
FIG. 7 shows a front elevation view of an embodiment of the present invention, not to scale.

Continuing with the definitions of key golf club head dimensions, the "front-to-back" dimension, referred to as the FB dimension, is the distance from the furthest forward point at the leading edge of the golf club head to the furthest rearward point at the rear of the golf club head, i.e. the trailing edge, as seen in FIG. 6. The "heel-to-toe" dimension, referred to as the HT dimension, is the distance from the point on the surface of the club head on the toe side that is furthest from the origin in the X-direction, to the point on the surface of the golf club head on the heel side that is 0.875" above the ground plane and furthest from the origin in the negative X-direction, as seen in FIG. 7.

Figure 9:
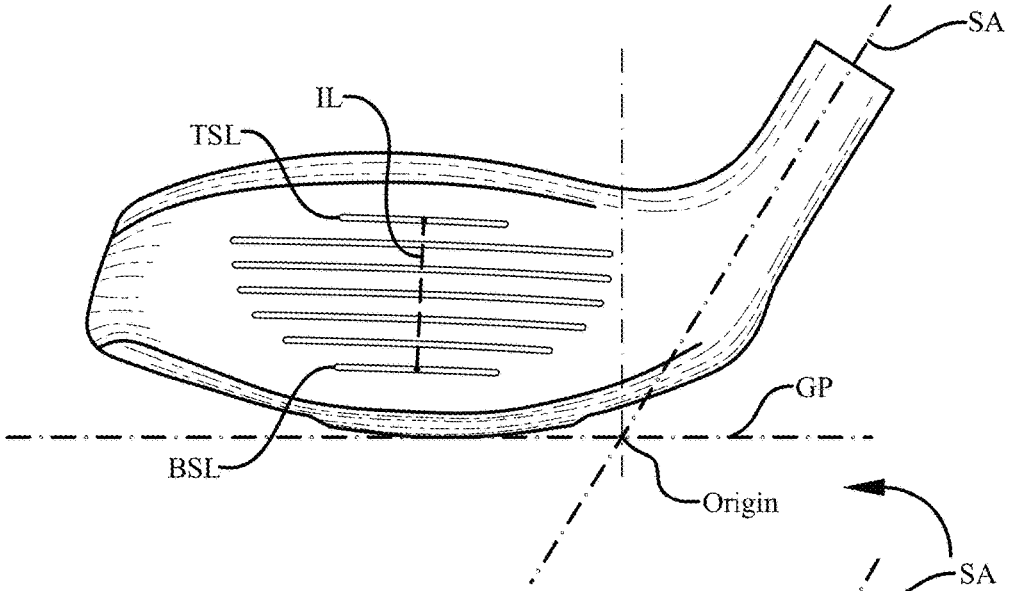
FIG. 9 shows a front elevation view of an embodiment of the present invention, not to scale.
Figure 10:
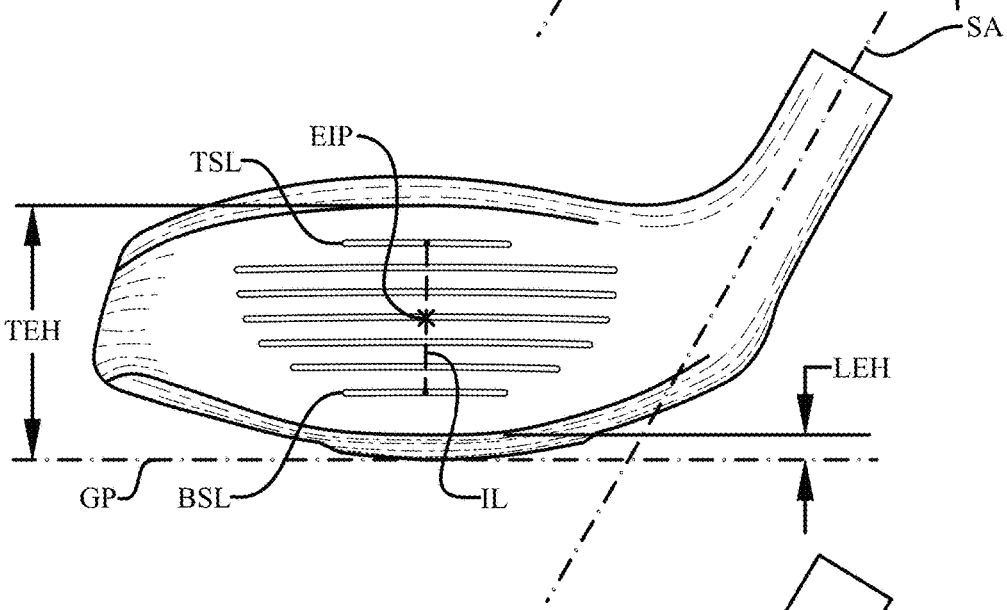
FIG. 10 shows a front elevation view of an embodiment of the present invention, not to scale.

A key location on the golf club face is an engineered impact point (EIP). The engineered impact point (EIP) is important in that is helps define several other key attributes of the present invention. The engineered impact point (EIP) is generally thought of as the point on the face that is the ideal point at which to strike the golf ball. Generally, the score lines on golf club heads enable one to easily identify the engineered impact point (EIP) for a golf club. In the embodiment of FIG. 9, the first step in identifying the engineered impact point (EIP) is to identify the top score line (TSL) and the bottom score line (BSL). Next, draw an imaginary line (IL) from the midpoint of the top score line (TSL) to the midpoint of the bottom score line (BSL). This imaginary line (IL) will often not be vertical since many score line designs are angled upward toward the toe when the club is in the natural position. Next, as seen in FIG. 10, the club must be rotated so that the top score line (TSL) and the bottom score line (BSL) are parallel with the ground plane (GP), which also means that the imaginary line (IL) will now be vertical. In this position, the leading edge height (LEH) and the top edge height (TEH) are measured from the ground plane (GP). Next, the face height is determined by subtracting the leading edge height (LEH) from the top edge height (TEH). The face height is then divided in half and added to the leading edge height (LEH) to yield the height of the engineered impact point (EIP). Continuing with the club head in the position of FIG. 10, a spot is marked on the imaginary line (IL) at the height above the ground plane (GP) that was just calculated. This spot is the engineered impact point (EIP).

Figure 11:
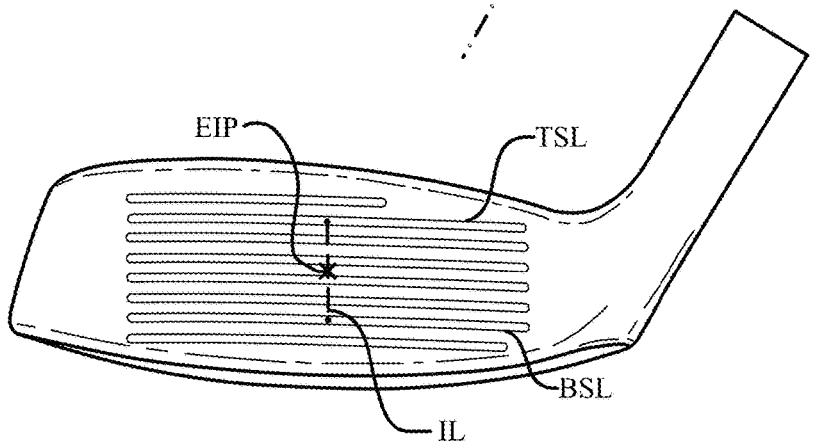
FIG. 11 shows a front elevation view of an embodiment of the present invention, not to scale.
Figure 12:
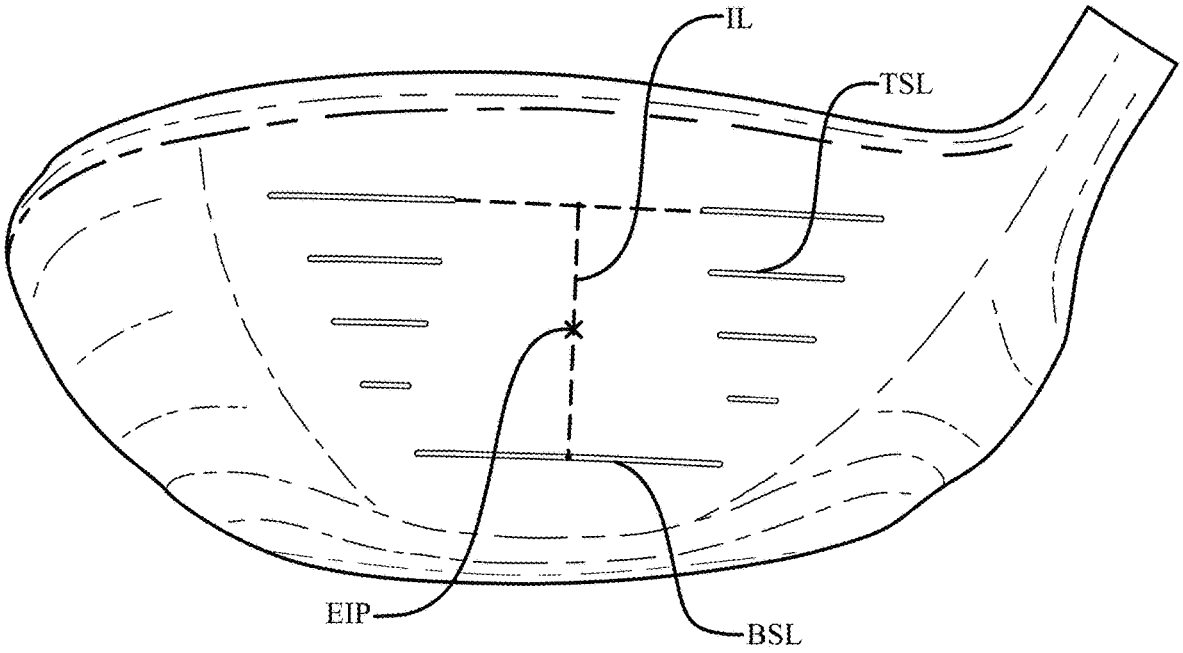
FIG. 12 shows a front elevation view of an embodiment of the present invention, not to scale.

The engineered impact point (EIP) may also be easily determined for club heads having alternative score line configurations. For instance, the golf club head of FIG. 11 does not have a centered top score line. In such a situation, the two outermost score lines that have lengths within 5% of one another are then used as the top score line (TSL) and the bottom score line (BSL). The process for determining the location of the engineered impact point (EIP) on the face is then determined as outlined above. Further, some golf club heads have non-continuous score lines, such as that seen at the top of the club head face in FIG. 12. In this case, a line is extended across the break between the two top score line sections to create a continuous top score line (TSL). The newly created continuous top score line (TSL) is then bisected and used to locate the imaginary line (IL). Again, then the process for determining the location of the engineered impact point (EIP) on the face is then determined as outlined above.

The engineered impact point (EIP) may also be easily determined in the rare case of a golf club head having an asymmetric score line pattern, or no score lines at all. In such embodiments the engineered impact point (EIP) shall be determined in accordance with the USGA "Procedure for Measuring the Flexibility of a Golf Clubhead," Revision 2.0, Mar. 25, 2005, which is incorporated herein by reference. This USGA procedure identifies a process for determining the impact location on the face of a golf club that is to be tested, also referred therein as the face center. The USGA procedure utilizes a template that is placed on the face of the golf club to determine the face center. In these limited cases of asymmetric score line patterns, or no score lines at all, this USGA face center shall be the engineered impact point (EIP) that is referenced throughout this application.

The engineered impact point (EIP) on the face is an important reference to define other attributes of the present invention. The engineered impact point (EIP) is generally shown on the face with rotated crosshairs labeled EIP.

Figure 8:
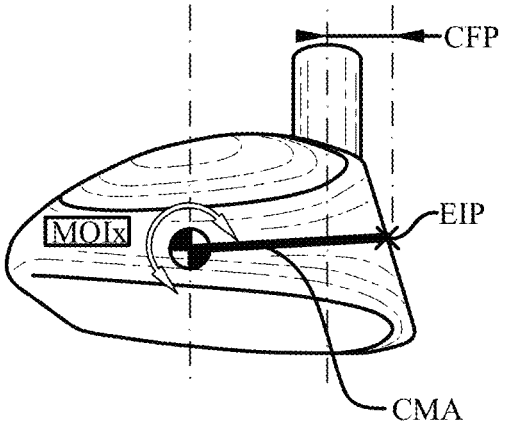
FIG. 8 shows a toe side elevation view of an embodiment of the present invention, not to scale.
Figure 14:
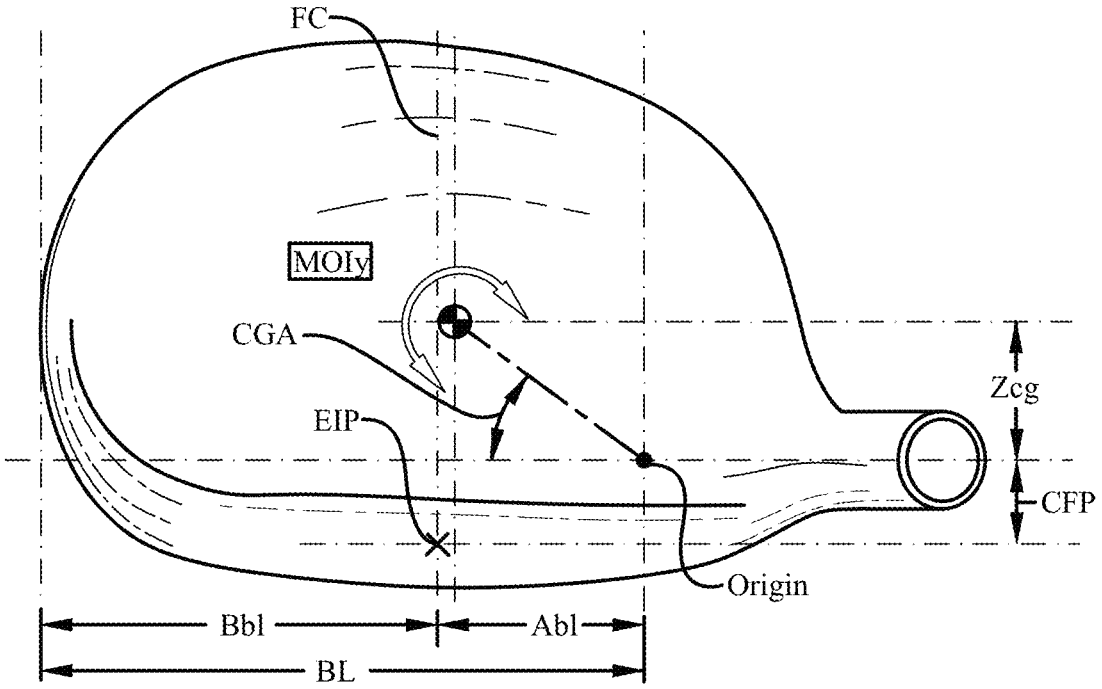
FIG. 14 shows a top plan view of an embodiment of the present invention, not to scale.

One important dimension that utilizes the engineered impact point (EIP) is the center face progression (CFP), seen in FIGS. 8 and 14. The center face progression (CFP) is a single dimension measurement and is defined as the distance in the Z-direction from the shaft axis (SA) to the engineered impact point (EIP). A second dimension that utilizes the engineered impact point (EIP) is referred to as a club moment arm (CMA). The CMA is the two dimensional distance from the CG of the club head to the engineered impact point (EIP) on the face, as seen in FIG. 8. Thus, with reference to the coordinate system shown in FIG. 1, the club moment arm (CMA) includes a component in the Z-direction and a component in the Y-direction, but ignores the any difference in the X-direction between the CG and the engineered impact point (EIP). Thus, the club moment arm (CMA) can be thought of in terms of an impact vertical plane passing through the engineered impact point (EIP) and extending in the Z-direction. First, one would translate the CG horizontally in the X-direction until it hits the impact vertical plane. Then, the club moment arm (CMA) would be the distance from the projection of the CG on the impact vertical plane to the engineered impact point (EIP). The club moment arm (CMA) has a significant impact on the launch angle and the spin of the golf ball upon impact.

Figure 13:
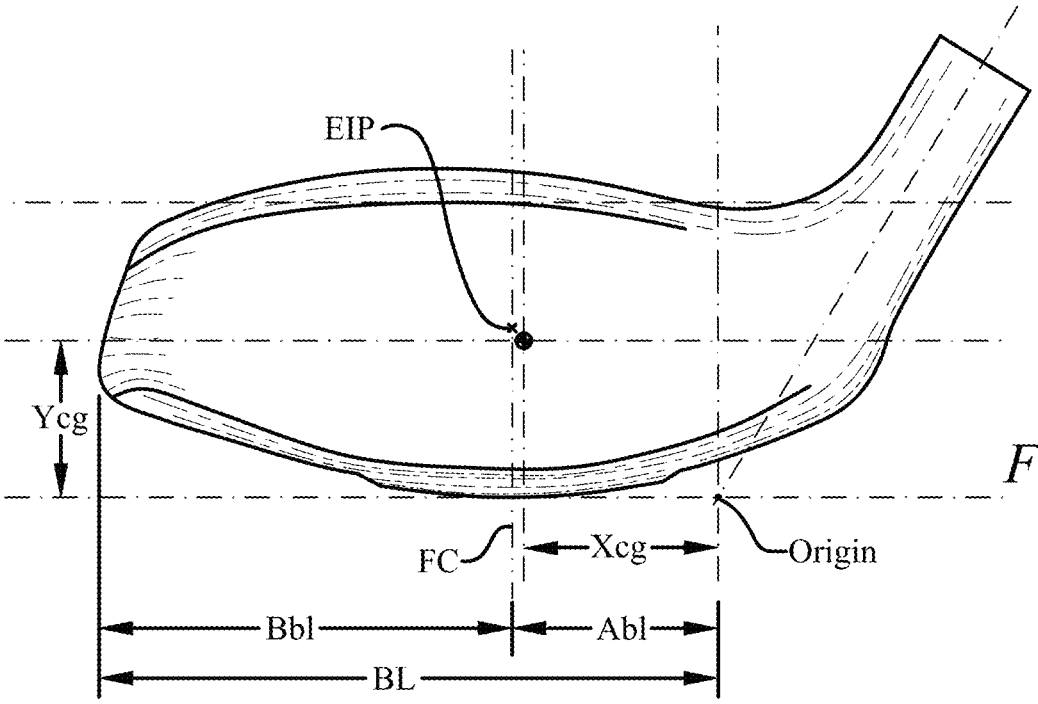
FIG. 13 shows a front elevation view of an embodiment of the present invention, not to scale.
Figure 26:
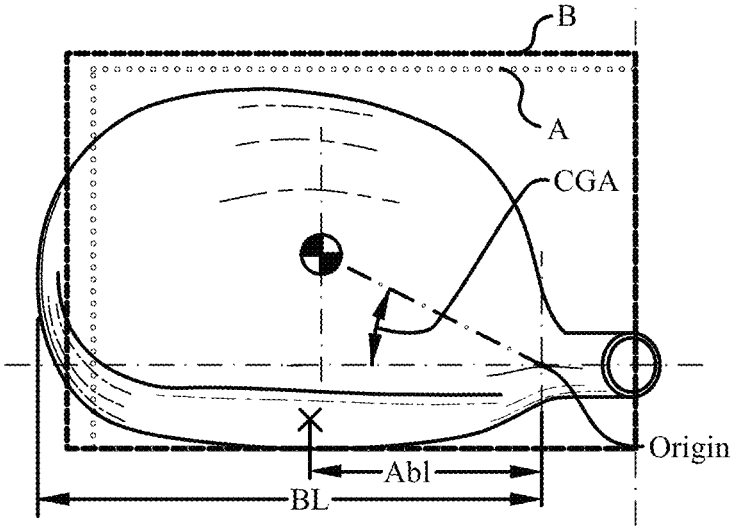
FIG. 26 shows a top plan view of an embodiment of the present invention, not to scale.

Another important dimension in golf club design is the club head blade length (BL), seen in FIG. 13 and FIG. 14. The blade length (BL) is the distance from the origin to a point on the surface of the club head on the toe side that is furthest from the origin in the X-direction. The blade length (BL) is composed of two sections, namely the heel blade length section (Abl) and the toe blade length section (Bbl). The point of delineation between these two sections is the engineered impact point (EIP), or more appropriately, a vertical line, referred to as a face centerline (FC), extending through the engineered impact point (EIP), as seen in FIG. 13, when the golf club head is in the normal resting position, also referred to as the design position. Further, several additional dimensions are helpful in understanding the location of the CG with respect to other points that are essential in golf club engineering. First, a CG angle (CGA) is the one dimensional angle between a line connecting the CG to the origin and an extension of the shaft axis (SA), as seen in FIGS. 14 and 26. The CG angle (CGA) is measured solely in the X-Z plane and therefore does not account for the elevation change between the CG and the origin, which is why it is easiest understood in reference to the top plan views of FIGS. 14 and 26.

Figure 15:
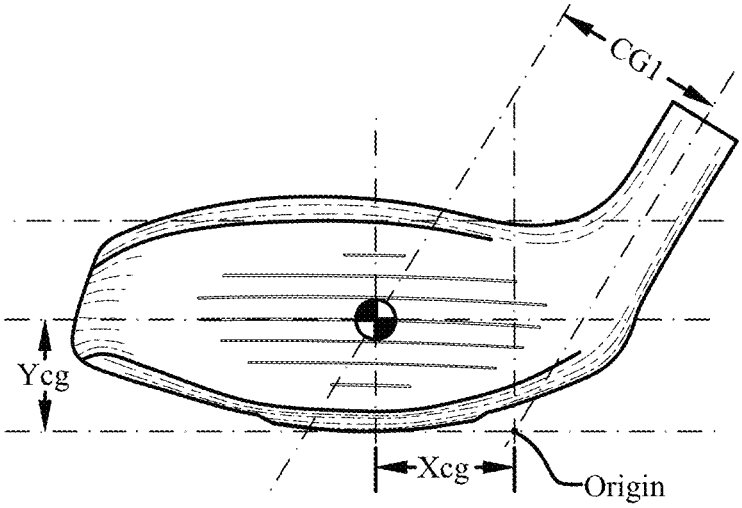
FIG. 15 shows a front elevation view of an embodiment of the present invention, not to scale.
Figure 16:
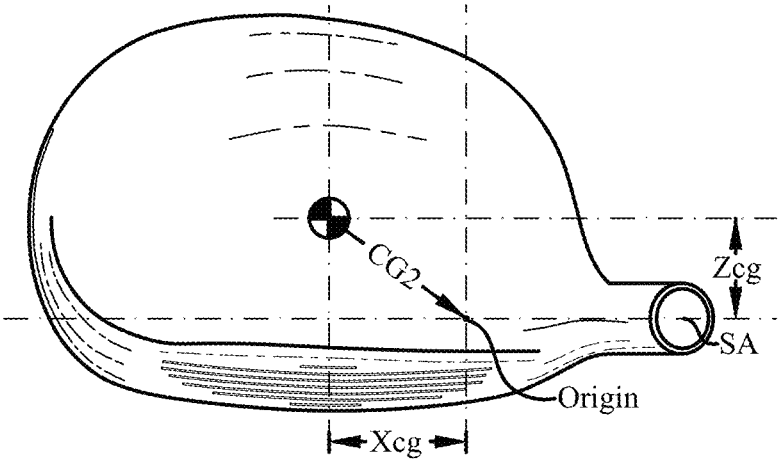
FIG. 16 shows a top plan view of an embodiment of the present invention, not to scale.
Figure 27:
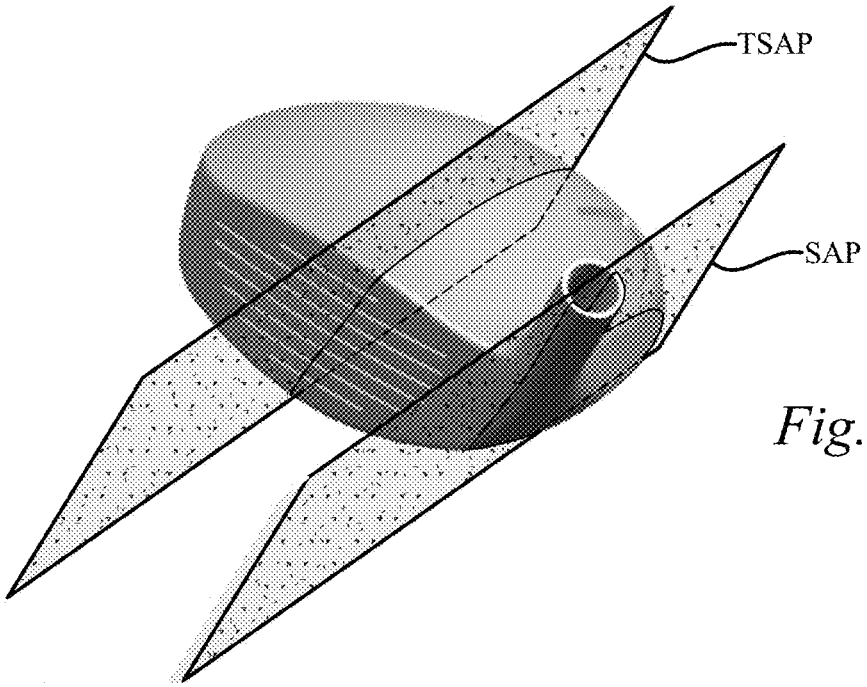
FIG. 27 shows a perspective view of an embodiment of the present invention, not to scale.
Figure 28:
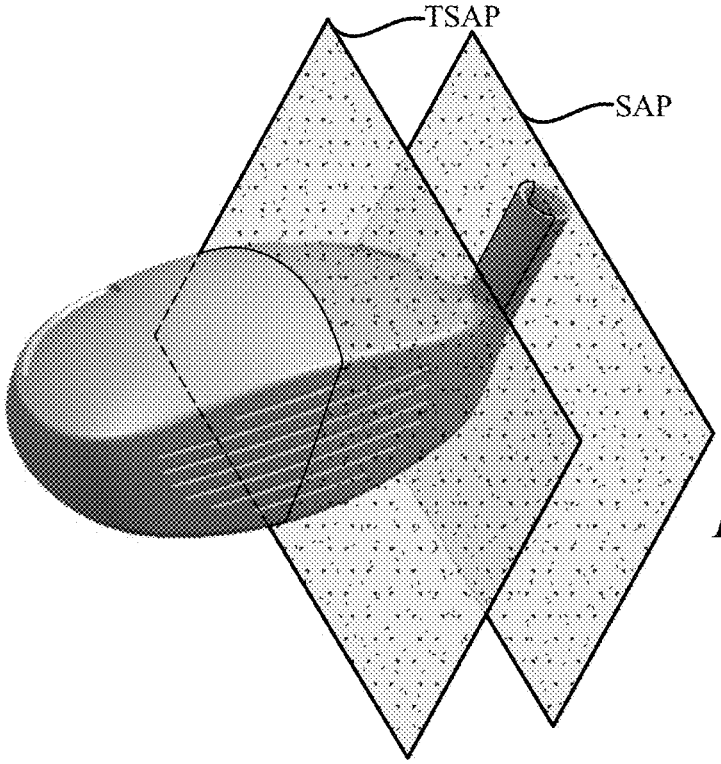
FIG. 28 shows a perspective view of an embodiment of the present invention, not to scale.

A dimension referred to as CG1, seen in FIG. 15, is most easily understood by identifying two planes through the golf club head, as seen in FIGS. 27 and 28. First, a shaft axis plane (SAP) is a plane through the shaft axis that extends from the face to the rear portion of the golf club head in the Z-direction. Next, a second plane, referred to as the translated shaft axis plane (TSAP), is a plane parallel to the shaft axis plane (SAP) but passing through the GC. Thus, in FIGS. 27 and 28, the translated shaft axis plane (TSAP) may be thought of as a copy of the shaft axis plane (SAP) that has been slid toward the toe until it hits the CG. Now, the CG1 dimension is the shortest distance from the CG to the shaft axis plane (SAP). A second dimension referred to as CG2, seen in FIG. 16 is the shortest distance from the CG to the origin point, thus taking into account elevation changes in the Y-direction.

Figure 17:
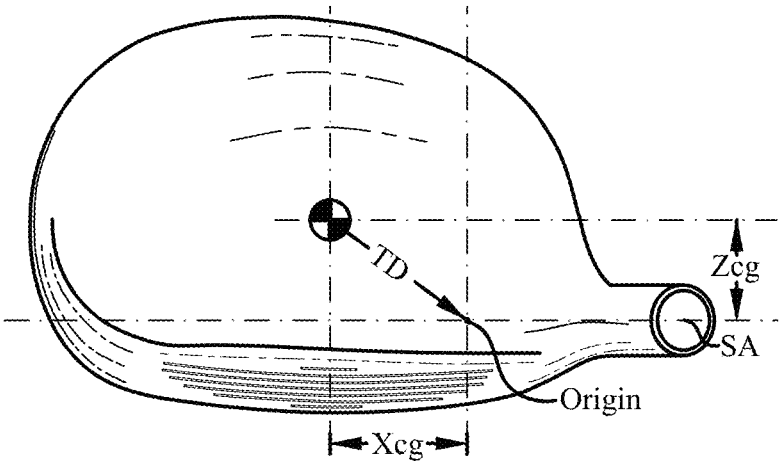
FIG. 17 shows a top plan view of an embodiment of the present invention, not to scale.

Lastly, another important dimension in quantifying the present invention only takes into consideration two dimensions and is referred to as the transfer distance (TD), seen in FIG. 17. The transfer distance (TD) is the horizontal distance from the CG to a vertical line extending from the origin; thus, the transfer distance (TD) ignores the height of the CG, or Ycg. Thus, using the Pythagorean Theorem from simple geometry, the transfer distance (TD) is the hypotenuse of a right triangle with a first leg being Xcg and the second leg being Zcg.

The transfer distance (TD) is significant in that is helps define another moment of inertia value that is significant to the present invention. This new moment of inertia value is defined as the face closing moment of inertia, referred to as MOIfc, which is the horizontally translated (no change in Y-direction elevation) version of MOIy around a vertical axis that passes through the origin. MOIfc is calculated by adding MOIy to the product of the club head mass and the transfer distance (TD) squared. Thus, $$MOIfc=MOIy+(mass*(TD)^2)$$

Figure 18:
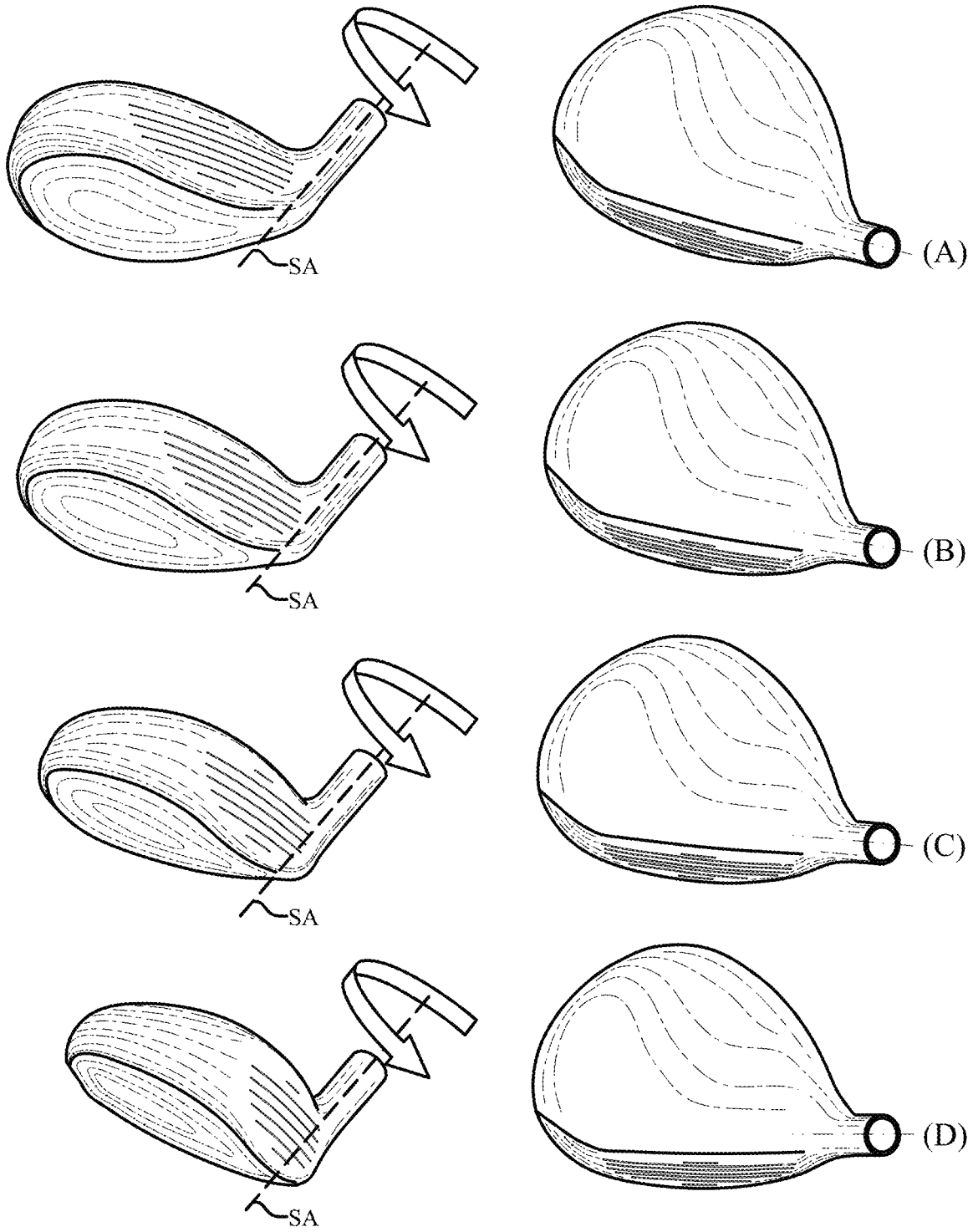
FIG. 18 shows a step-wise progression of an embodiment of the present invention as the golf club head approaches the impact with a golf ball during a golf swing, not to scale.
Figure 19:
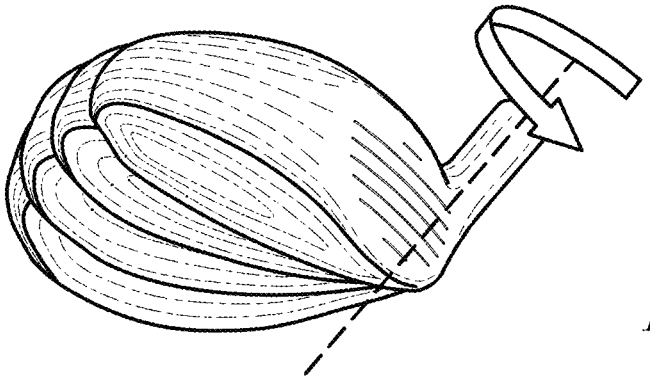
FIG. 19 shows a step-wise progression of an embodiment of the present invention as the golf club head approaches the impact with a golf ball during a golf swing, not to scale.
Figure 20:
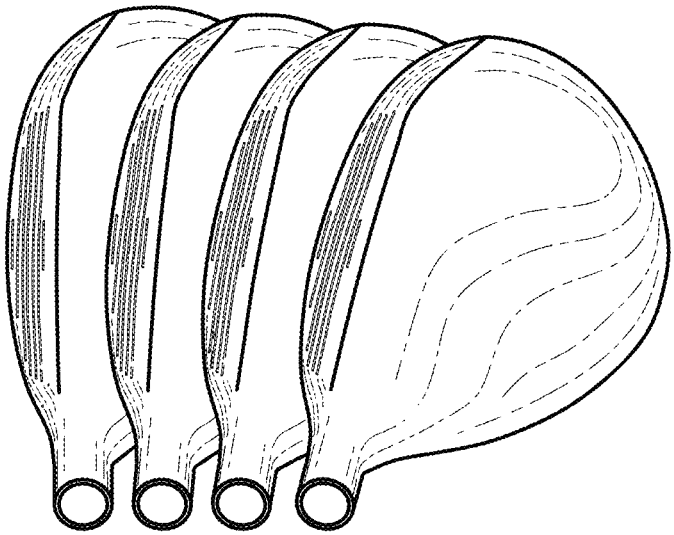
FIG. 20 shows a step-wise progression of an embodiment of the present invention as the golf club head approaches the impact with a golf ball during a golf swing, not to scale.

The face closing moment (MOIfc) is important because is represents the resistance that a golfer feels during a swing when trying to bring the club face back to a square position for impact with the golf ball. In other words, as the golf swing returns the golf club head to its original position to impact the golf ball the face begins closing with the goal of being square at impact with the golf ball. For instance, the figures of FIGS. 18(A), (B), (C), and (D) illustrate the face of the golf club head closing during the downswing in preparation for impact with the golf ball. This stepwise closing of the face is also illustrated in FIGS. 19 and 20. The significance of the face closing moment (MOIfc) will be explained later herein.

Figure 29:
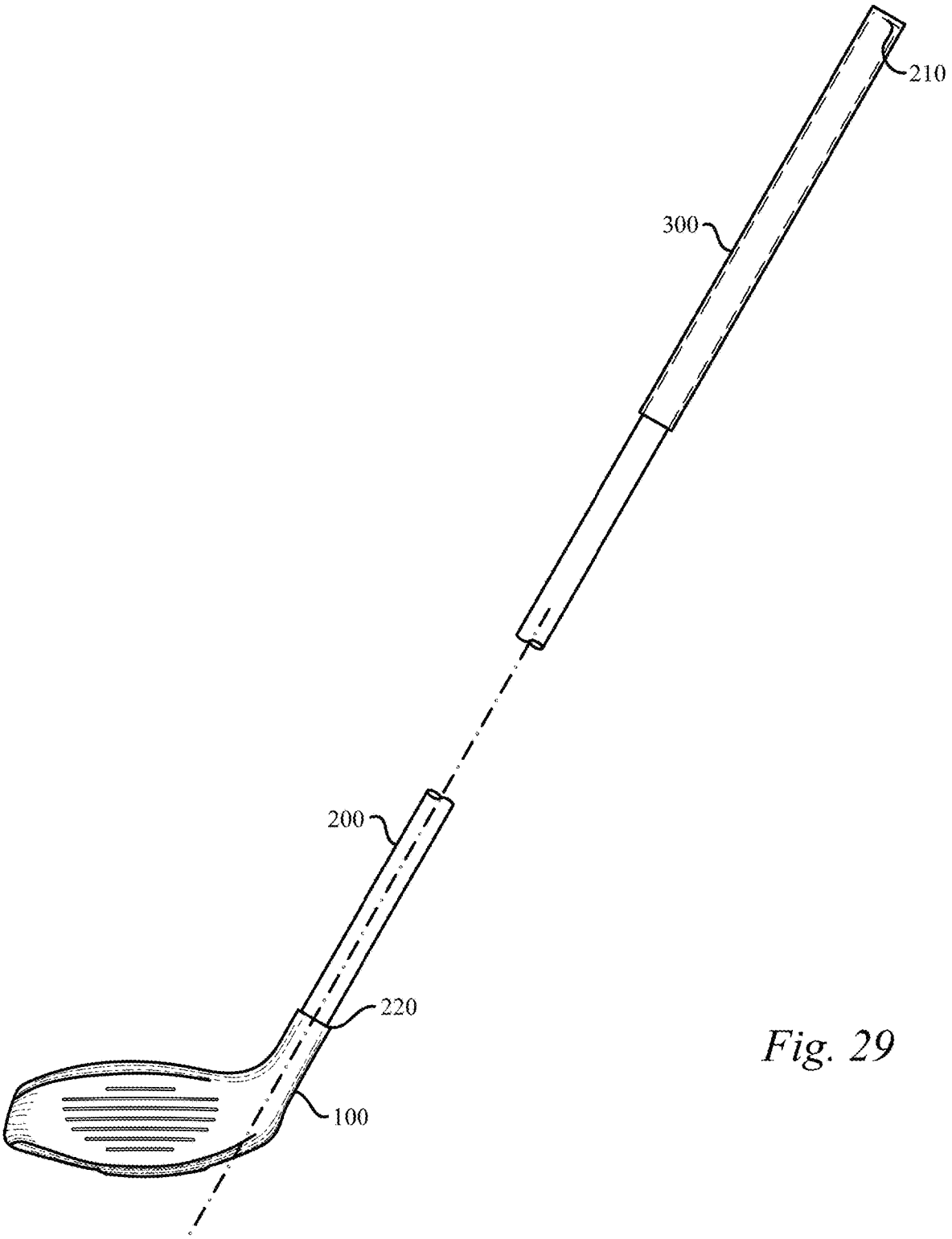
FIG. 29 shows a front elevation view of an embodiment of the present invention, not to scale.

The fairway wood type golf club of the present invention has a shape and mass distribution unlike prior fairway wood type golf clubs. The fairway wood type golf club of the present invention includes a shaft (200) having a proximal end (210) and a distal end (220); a grip (300) attached to the shaft proximal end (210); and a golf club head (100) attached at the shaft distal end (220), as seen in FIG. 29. The overall fairway wood type golf club has a club length of at least 41 inches and no more than 45 inches, as measure in accordance with USGA guidelines.

The golf club head (100) itself is a hollow structure that includes a face positioned at a front portion of the golf club head where the golf club head impacts a golf ball, a sole positioned at a bottom portion of the golf club head, a crown positioned at a top portion of the golf club head, and a skirt positioned around a portion of a periphery of the golf club head between the sole and the crown. The face, sole, crown, and skirt define an outer shell that further defines a head volume that is less than 250 cubic centimeters for the present invention. Additionally, the golf club head has a rear portion opposite the face. The rear portion includes the trailing edge of the golf club, as is understood by one with skill in the art. The face has a loft of at least 12 degrees and no more than 27 degrees, and the face includes an engineered impact point (EIP) as defined above. One skilled in the art will appreciate that the skirt may be significant at some areas of the golf club head and virtually nonexistent at other areas; particularly at the rear portion of the golf club head where it is not uncommon for it to appear that the crown simply wraps around and becomes the sole.

The golf club head (100) includes a bore having a center that defines a shaft axis (SA) which intersects with a horizontal ground plane (GP) to define an origin point, as previously explained. The bore is located at a heel side of the golf club head and receives the shaft distal end for attachment to the golf club head. The golf club head (100) also has a toe side located opposite of the heel side. The golf club head (100) of the present invention has a club head mass of less than 230 grams, which combined with the previously disclosed loft, club head volume, and club length establish that the present invention is directed to a fairway wood golf club.

As previously explained, the golf club head (100) has a blade length (BL) that is measured horizontally from the origin point toward the toe side of the golf club head a distance that is parallel to the face and the ground plane (GP) to the most distant point on the golf club head in this direction. The golf club head (100) of the present invention has a blade length (BL) of at least 3.1 inches. Further, the blade length (BL) includes a heel blade length section (Abl) and a toe blade length section (Bbl). The heel blade length section (Abl) is measured in the same direction as the blade length (BL) from the origin point to the vertical line extending through the engineered impact point (EIP), and in the present invention the heel blade length section (Abl) is at least 1.1 inches. As will be subsequently explained, the blade length (BL) and the heel blade length section (Abl) of the present invention are unique to the field of fairway woods, particularly when combined with the disclosure below regarding the relatively small club moment arm (CMA), high MOIy, in some embodiments, and very low center of gravity, in some embodiments, which fly in the face of conventional golf club design engineering.

The golf club head (100) of the present invention has a center of gravity (CG) located (a) vertically toward the top portion of the golf club head from the origin point a distance Ycg; (b) horizontally from the origin point toward the toe side of the golf club head a distance Xcg that is generally parallel to the face and the ground plane (GP); and (c) a distance Zcg from the origin toward the rear portion in a direction orthogonal to the vertical direction used to measure Ycg and orthogonal to the horizontal direction used to measure Xcg.

The present golf club head (100) has a club moment arm (CMA) from the CG to the engineered impact point (EIP) of less than 1.1 inches. The definition of the club moment arm (CMA) and engineered impact point (EIP) have been disclosed in great detail above and therefore will not be repeated here. This is particularly significant when contrasted with the fact that one embodiment of the present invention has a first moment of inertia (MOIy) about a vertical axis through the CG of at least 3000 g*cm$^2$, which is high in the field of fairway wood golf clubs, as well as the blade length (BL) and heel blade length section (Abl) characteristics previously explained.

The advances of the present invention are significant because prior thinking in the field of fairway woods has generally led to one of two results, both of which lack the desired high MOIy, or the desired low CG, depending on the embodiment, combined with the other properties of the claimed invention.

Figure 25:
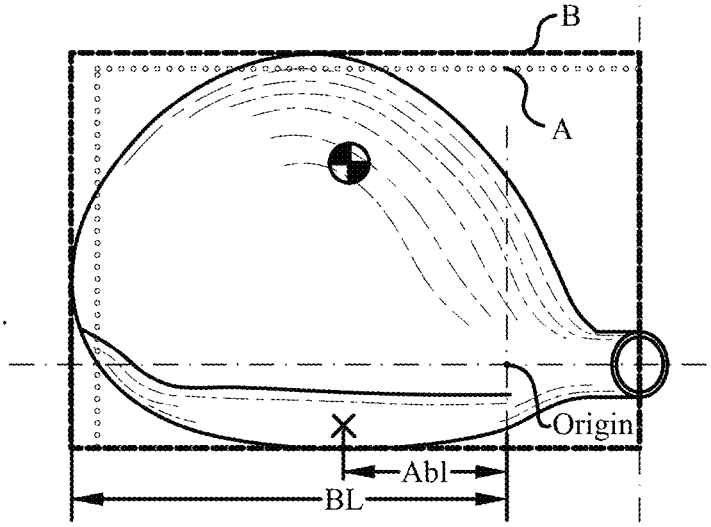
FIG. 25 shows a top plan view of a prior art oversized fairway wood, not to scale.

The first common trend has been to produce oversized fairway woods, such as prior art product R in the table of FIG. 30, in which an oversized head was used to obtain a relatively high MOIy at the expense of a particular large club moment arm (CMA) value of almost 1.3 inches, which is over 17.5 percent greater than the maximum club moment arm (CMA) of the present invention. Further, this prior art large club moment arm (CMA) club does not obtain the specified desired heel blade length section (Abl) dimension of the present invention. This is particularly illustrative of common thinking in club head engineering that to produce a high MOIy game improvement type product that the club head must get large in all directions, which results in a CG located far from the face of the club and thus a large club moment arm (CMA). A generic oversized fairway wood is seen in FIG. 25. The club moment arm (CMA) has a significant impact on the ball flight of off-center hits. Importantly, a shorter club moment arm (CMA) produces less variation between shots hit at the engineered impact point (EIP) and off-center hits. Thus, a golf ball struck near the heel or toe of the present invention will have launch conditions more similar to a perfectly struck shot. Conversely, a golf ball struck near the heel or toe of an oversized fairway wood with a large club moment arm (CMA) would have significantly different launch conditions than a ball struck at the engineered impact point (EIP) of the same oversized fairway wood.

Generally, larger club moment arm (CMA) golf clubs impart higher spin rates on the golf ball when perfectly struck in the engineered impact point (EIP) and produce larger spin rate variations in off-center hits. The present invention's reduction of club moment arm (CMA) while still obtaining a high MOIy and/or low CG position, and the desired minimum heel blade length section (Abl) is opposite of what prior art designs have attempted to achieve with oversized fairway woods, and has resulted in a fairway wood with more efficient launch conditions including a lower ball spin rate per degree of launch angle, thus producing a longer ball flight.

Figure 24:
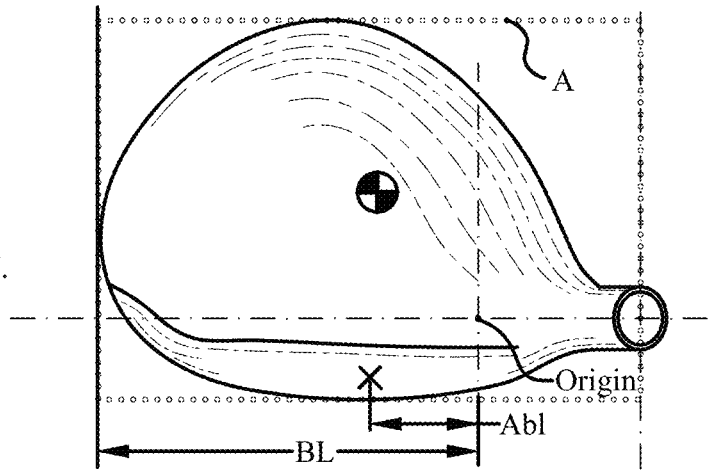
FIG. 24 shows a top plan view of a prior art conventional fairway wood, not to scale.

The second common trend in fairway wood design has been to stick with smaller club heads for more skilled golfers, as seen in FIG. 24. One basis for this has been to reduce the amount of ground contact. Unfortunately, the smaller club head results in a reduced hitting area making these clubs difficult for the average golfer to hit. A good example of one such club is prior art product I in the table of FIG. 30. Prior art product I has achieved a small club moment arm (CMA), but has done so at the expense of small blade length (BL) of 2.838 inches, a small heel blade length section (Abl) dimension of 0.863 inches. Thus, the present invention's increase in blade length (BL) and the minimum heel blade length section (Abl), while being able to produce a high MOIy, or very low CG elevation, with a small club moment arm (CMA), is unique.

Both of these trends have ignored the changes found in the rest of the golf clubs in a golfer's bag. As will be discussed in detail further below, advances in driver technology and hybrid iron technology have left fairway woods feeling unnatural and undesirable.

In addition to everything else, the prior art has failed to identify the value in having a fairway wood's engineered impact point (EIP) located a significant distance from the origin point. Conventional wisdom regarding increasing the Zcg value to obtain club head performance has proved to not recognize that it is the club moment arm (CMA) that plays a much more significant role in fairway wood performance and ball flight. Controlling the club moments arm (CMA) in the manner claimed herein, along with the long blade length (BL), long heel blade length section (Abl), while achieving a high MOIy, or low CG position, for fairway woods, yields launch conditions that vary significantly less between perfect impacts and off-center impacts than has been seen in the past. The present invention provides the penetrating ball flight that is desired with fairway woods via reducing the ball spin rate per degree of launch angle. The presently claimed invention has resulted in reductions in ball spin rate as much as 5 percent or more, while maintaining the desired launch angle. In fact, testing has shown that each hundredth of an inch reduction in club moment arm (CMA) results in a reduction in ball spin rate of up to 13.5 rpm.

Figure 21:
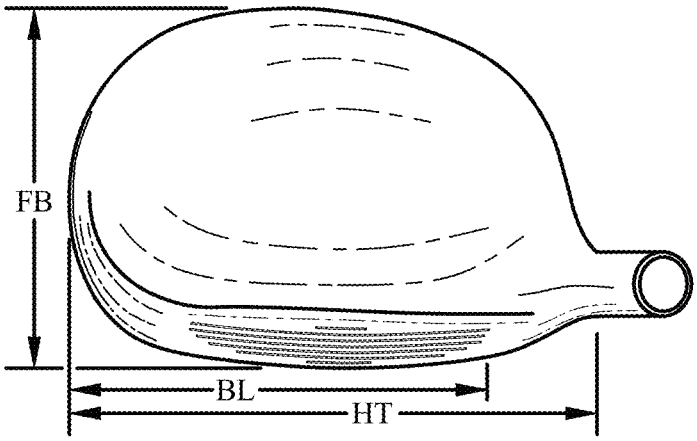
FIG. 21 shows a top plan view of an embodiment of the present invention, not to scale.
Figure 22:
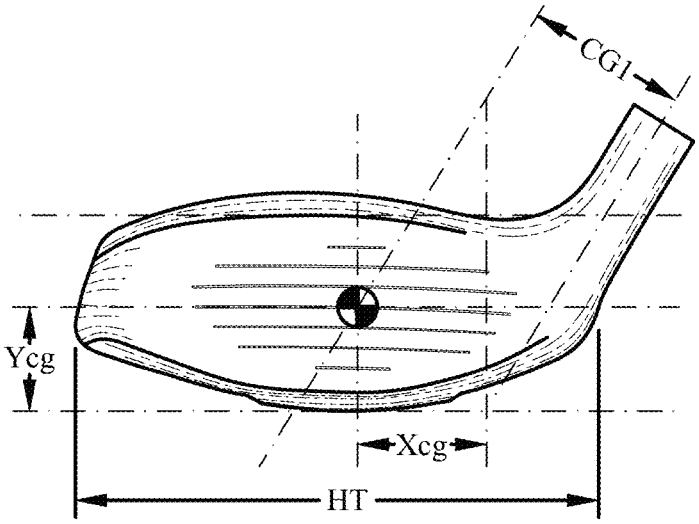
FIG. 22 shows a front elevation view of an embodiment of the present invention, not to scale.
Figure 23:
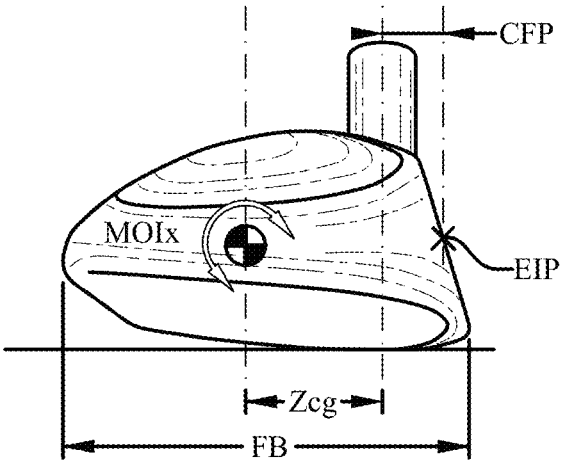
FIG. 23 shows a toe side elevation view of an embodiment of the present invention, not to scale.

In another embodiment of the present invention the ratio of the golf club head front-to-back dimension (FB) to the blade length (BL) is less than 0.925, as seen in FIG. 21. The table FIG. 31 is the table of FIG. 30 with two additional rows added to the bottom illustrating typical prior art front-to-back dimensions (FB) and the associated ratios of front-to-back dimensions (FB) to blade lengths (BL). In this embodiment, the limiting of the front-to-back dimension (FB) of the club head (100) in relation to the blade length (BL) improves the playability of the club, yet still achieves the desired high MOIy, or low CG location, and small club moment arm (CMA). The reduced front-to-back dimension (FB), and associated reduced Zcg, of the present invention also significantly reduces dynamic lofting of the golf club head. In FIG. 31 only prior art products P, Q, and T even obtain ratios below 1, nowhere near 0.925, and further do not obtain the other characteristics previously discussed. Increasing the blade length (BL) of a fairway wood, while decreasing the front-to-back dimension (FB) and incorporating the previously discussed characteristics with respect to minimum MOIy, minimum heel blade length section (Abl), and maximum club moment arm (CMA), simply goes against conventional fairway wood golf club head design and produces a golf club head that has improved playability that would not be expected by one practicing conventional fairway wood design principles. Reference to FIGS. 24, 25, and 26 illustrates nicely the unique geometric differences between the present embodiment and prior art fairway woods. In a further embodiment, such as that of FIG. 26, the face, sole, crown, and skirt define an outer shell that further defines a head volume that is less than 170 cubic centimeters In yet a further embodiment a unique ratio of the heel blade length section (Abl) to the golf club head front-to-back dimension (FB) has been identified and is at least 0.32. The table shown in FIG. 32 replaces the last row of the table of FIG. 31 with this new ratio of heel blade length section (Abl) to the golf club head front-to-back dimension (FB), as well as adding a row illustrating the face closing moment (MOIfc). Prior art products O, P, Q, and T obtain ratios above 0.32, but are all low MOIy and low face closing moment (MOIfc) clubs that also fail to achieve the present invention's heel blade length section (Abl) value.

Still another embodiment of the present invention defines the long blade length (BL), long heel blade length section (Abl), and short club moment arm (CMA) relationship through the use of a CG angle (CGA) of no more than 30 degrees. The CG angle (CGA) was previously defined in detail above. Fairway woods with long heel blade length sections (Abl) simply have not had CG angles (CGA) of 30 degrees or less. Generally longer blade length (BL) fairway woods have CG locations that are further back in the golf club head and therefore have large CG angles (CGA), common for oversized fairway woods. For instance, the longest blade length (BL) fairway wood seen in FIG. 33 has a blade length (BL) of 3.294 inches and correspondingly has a CG angle (CGA) of over 33 degrees. A small CG angle (CGA) affords the benefits of a golf club head with a small club moment arm (CMA) and a CG that is far from the origin in the X-direction. An even further preferred embodiment of the present invention has a CG angle (CGA) of 25 degrees or less, further espousing the performance benefits discussed herein.

Yet another embodiment of the present invention expresses the unique characteristics of the present fairway wood in terms of a ratio of the club moment arm (CMA) to the heel blade length section (Abl). In this embodiment the ratio of club moment arm (CMA) to the heel blade length section (Abl) is less than 0.9. The only prior art fairway woods seen in FIG. 34 that fall below this ratio are prior art products O and P, which fall dramatically below the claimed MOIy or the claim Ycg distance, the specified heel blade length section (Abl), and prior art product O further has a short blade length (BL).

Still a further embodiment uniquely characterizes the present fairway wood golf club head with a ratio of the heel blade length section (Abl) to the blade length (BL) that is at least 0.33. The only prior art product in FIG. 35 that meets this ratio along with a blade length (BL) of at least 3.1 inches is prior art product R, which again has a club moment arm (CMA) more than 17 percent greater than the present invention and thus all the undesirable attributes associated with a long club moment arm (CMA) club.

Yet another embodiment further exhibits a club head attribute that goes against traditional thinking regarding a short club moment arm (CMA) club, such as the present invention. In this embodiment the previously defined transfer distance (TD) is at least 1.2 inches. In this embodiment the present invention is achieving a club moment arm (CMA) less than 1.1 inches while achieving a transfer distance (TD) of at least 1.2 inches. Conventional wisdom would lead one skilled in the art to generally believe that the magnitudes of the club moment arm (CMA) and the transfer distance (TD) should track one another.

In the past golf club design has made MOIy a priority. Unfortunately, MOIy is solely an impact influencer; in other words, MOIy represents the club head's resistance to twisting when a golf ball is struck toward the toe side, or heel side, of the golf club. The present invention recognizes that a second moment of inertia, referred to above as the face closing moment, (MOIfc) also plays a significant role in producing a golf club that is particularly playable by even unskilled golfers. As previously explained, the claimed second moment of inertia is the face closing moment of inertia, referred to as MOIfc, which is the horizontally translated (no change in Y-direction elevation) version of MOIy around a vertical axis that passes through the origin. MOIfc is calculated by adding MOIy to the product of the club head mass and the transfer distance (TD) squared. Thus, $$MOIfc=MOIy+(mass*(TD)^2)$$

The transfer distance (TD) in the equation above must be converted into centimeters in order to obtain the desired MOI units of $g*cm^2$. The face closing moment (MOIfc) is important because is represents the resistance felt by a golfer during a swing as the golfer is attempting to return the club face to the square position. While large MOIy golf clubs are good at resisting twisting when off-center shots are hit, this does little good if the golfer has difficulty consistently bringing the club back to a square position during the swing. In other words, as the golf swing returns the golf club head to its original position to impact the golf ball the face begins closing with the goal of being square at impact with the golf ball. As MOIy increases, it is often more difficult for golfers to return the club face to the desired position for impact with the ball. For instance, the figures of FIGS. 18(A), (B), (C), and (D) illustrate the face of the golf club head closing during the downswing in preparation for impact with the golf ball. This stepwise closing of the face is also illustrated in FIGS. 19 and 20.

Figure 37:
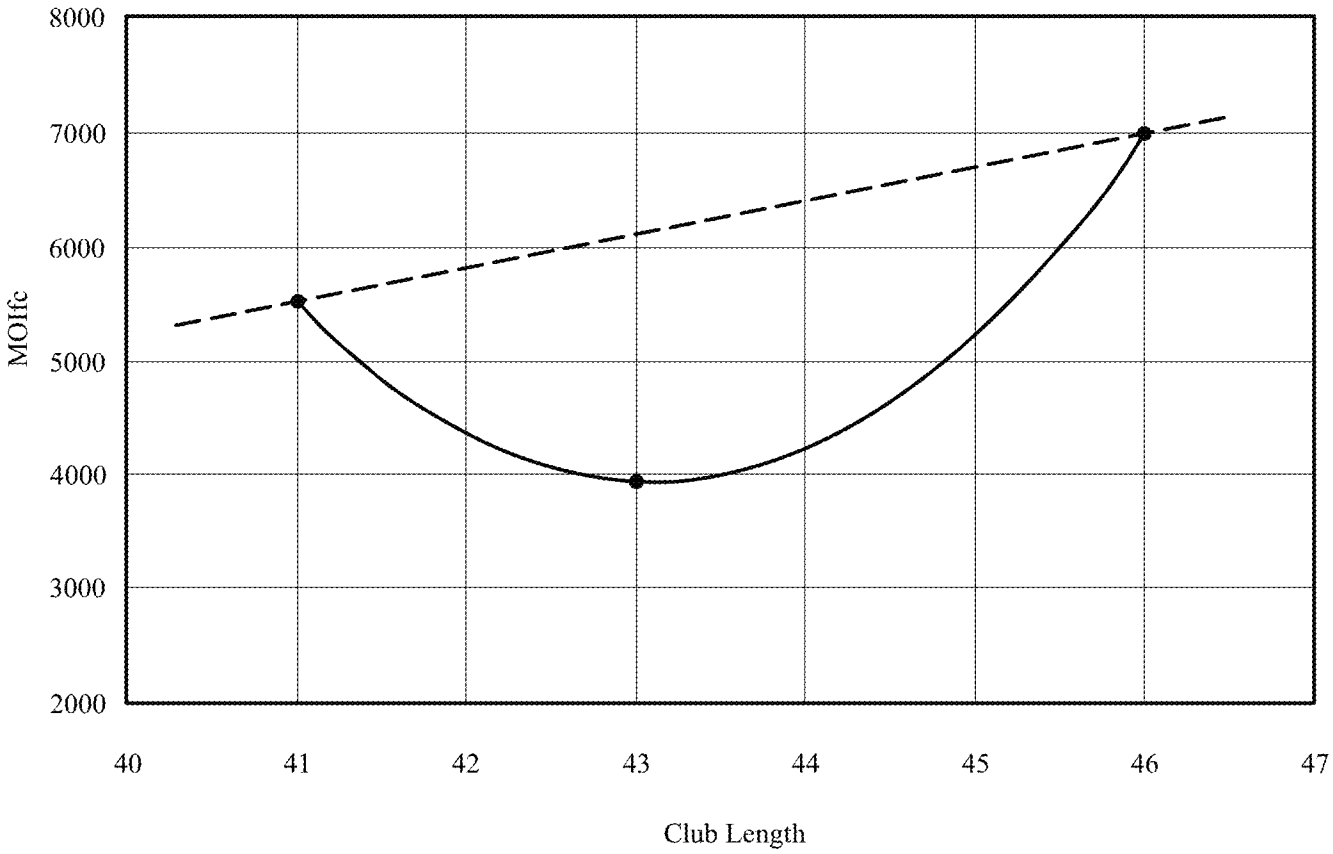
FIG. 37 is a graph of the face closing moment (MOIfc) versus club length.

Recently golfers have become accustomed to high MOIy golf clubs, particularly because of recent trends with modern drivers and hybrid irons. In doing so, golfers have trained themselves, and their swings, that the extra resistance to closing the club face during a swing associated with longer length golf clubs, i.e. high MOIy drivers and hybrid irons, is the "natural" feel of longer length golf clubs. The graph of FIG. 37 illustrates the face closing moment (MOIfc) compared to club length of modern prior art golf clubs. The left side of solid line curve on the graph illustrates the face closing moment (MOIfc) of an average hybrid long iron golf club, while the right side solid line curve of the graph illustrates the face closing moment (MOIfc) of an average high MOIy driver. The drop in the illustrated solid line curve at the 43 inch club length illustrates the face closing moment (MOIfc) of conventional fairway woods. Since golfers have trained themselves that a certain resistance to closing the face of a long club length golf club is the "natural" feel, conventional fairway woods no longer have that "natural" feel. The present invention provides a fairway wood with a face closing moment (MOIfc) that is more in line with hybrid long irons and high MOIy drivers resulting in a more natural feel in terms of the amount of effort expended to return the club face to the square position; all the while maintaining a short club moment arm (CMA). This more natural feel is achieved in the present invention by increasing the face closing moment (MOIfc) so that it approaches the straight dashed line seen in FIG. 37 connecting the face closing moment (MOIfc) of the hybrid long irons and high MOIy drivers. Thus, one embodiment distinguishes itself by having a face closing moment (MOIfc) of at least 4500 $g*cm^2$, or at least 4250 $g*cm^2$ in low CG elevation embodiments. Further, this beneficial face closing moment (MOIfc) to club length relationship may be expressed as a ratio. Thus, in yet another embodiment of the present invention the ratio of the face closing moment (MOIfc) to the club length is at least 135, or at least 95 in low CG elevation embodiments.

In the previously discussed embodiment the transfer distance (TD) is at least 1.2 inches. Thus, from the definition of the face closing moment (MOIfc) it is clear that the transfer distance (TD) plays a significant role in a fairway wood's feel during the golf swing such that a golfer squares the club face with the same feel as when they are squaring their driver's club face or their hybrid's club face; yet the benefits afforded by increasing the transfer distance (TD), while decreasing the club moment arm (CMA), have gone unrecognized until the present invention. The only prior art product seen in FIG. 36 with a transfer distance (TD) of at least 1.2 inches, while also having a club moment arm (CMA) of less than or equal to 1.1 inches, is prior art product I, which has a blade length (BL) over 8 percent less than the present invention, a heel blade length section (Abl) over 21 percent less than the present invention, and a MOIy over 10 percent less than some embodiments of the present invention.

A further embodiment of the previously described embodiment has recognized highly beneficial club head performance regarding launch conditions when the transfer distance (TD) is at least 10 percent greater than the club moment arm (CMA). Even further, a particularly effective range for fairway woods has been found to be when the transfer distance (TD) is 10 percent to 40 percent greater than the club moment arm (CMA). This range ensures a high face closing moment (MOIfc) such that bringing club head square at impact feels natural and takes advantage of the beneficial impact characteristics associated with the short club moment arm (CMA) and CG location.

The embodiments of the present invention discovered that in order to increase the face closing moment (MOIfc) such that it is closer to a roughly linear range between a hybrid long iron and a high MOIy driver, while reducing the club moment art (CMA), the heel blade length section (Abl) must be increased to place the CG in a more beneficial location. As previously mentioned, the present invention does not merely maximize MOIy because that would be short sighted. Increasing the MOIy while obtaining a desirable balance of club moment arm (CMA), blade length (BL), heel blade length section (Abl), and CG location involved identifying key relationships that contradict many traditional golf club head engineering principles. This is particularly true in an embodiment of the present invention that has a second moment of inertia, the face closing moment, (MOIfc) about a vertical axis through the origin of at least 5000 $g*cm^2$. Obtaining such a high face closing moment (MOIfc), while maintaining a short club moment arm (CMA), long blade length (BL), long heel blade length section (Abl), and high MOIy involved recognizing key relationships, and the associated impact on performance, not previously exhibited. In fact, in yet another embodiment one such desirable relationship found to be an indicator of a club heads playability, not only from a typical resistance to twisting at impact perspective, but also from the perspective of the ability to return the club head to the square position during a golf swing with a natural feel, is identified in a fairway wood golf club head that has a second moment of inertia (MOIfc) that is at least 50 percent greater than the MOIy multiplied by seventy-two and one-half percent of the heel blade length section (Abl). This unique relationship is a complex balance of virtually all the relationships previously discussed.

The concept of center face progression (CFP) has been previously defined and is often thought of as the offset of a golf club head, illustrated in FIG. 14. One embodiment of the present invention has a center face progression (CFP) of less than 0.525 inches. Additionally, in this embodiment the Zcg may be less than 0.65 inches, thus leading to a small club moment arm (CMA). In a further embodiment, the present invention has a center face progression (CFP) of less than 0.35 inches and a Zcg is less than 0.85 inches, further providing the natural feel required of a particularly playable fairway wood Yet another embodiment of the present invention further characterizes this unique high MOIy long blade length (BL) fairway wood golf club having a long heel blade length section (Abl) and a small club moment arm (CMA) in terms of a design efficiency. In this embodiment the ratio of the first moment of inertia (MOIy) to the head mass is at least 14. Further, in this embodiment the ratio of the second moment of inertia, or the face closing moment, (MOIfc) to the head mass is at least 23. Both of these efficiencies are only achievable by discovering the unique relationships that are disclosed herein.

Additional testing has shown that further refinements in the CG location, along with the previously described combination of the small club moment arm (CMA) with the long blade length (BL) and the long heel blade length section (Abl) may exceed the performance of many of the high MOIy embodiments just disclosed. Thus, all of the prior disclosure remains applicable, however now the presently claimed invention does not focus on achieving a high MOIy, in combination with all the other attributes, but rather the following embodiments focus on achieving a specific CG location in combination with the unique relationships of small club moment arm (CMA), long blade length (BL), and long heel blade length section (Abl), already disclosed in detail, in addition to a particular relationship between the top edge height (TEH) and the Ycg distance.

Referring now to FIG. 10, in one embodiment it was found that a particular relationship between the top edge height (TEH) and the Ycg distance further promotes desirable performance and feel. In this embodiment a preferred ratio of the Ycg distance to the top edge height (TEH) is less than 0.40; while still achieving a long blade length of at least 3.1 inches, including a heel blade length section (Abl) that is at least 1.1 inches, a club moment arm (CMA) of less than 1.1 inches, and a transfer distance (TD) of at least 1.2 inches, wherein the transfer distance (TD) is between 10 percent to 40 percent greater than the club moment arm (CMA). This ratio ensures that the CG is below the engineered impact point (EIP), yet still ensures that the relationship between club moment arm (CMA) and transfer distance (TD) are achieved with club head design having a long blade length (BL) and long heel blade length section (Abl). As previously mentioned, as the CG elevation decreases the club moment arm (CMA) increases by definition, thereby again requiring particular attention to maintain the club moment arm (CMA) at less than 1.1 inches while reducing the Ycg distance, maintaining a moderate MOIy, and a significant transfer distance (TD) necessary to accommodate the long blade length (BL) and heel blade length section (Abl). In an even further embodiment, a ratio of the Ycg distance to the top edge height (TEH) of less than 0.375 has produced even more desirable ball flight properties. Generally the top edge height (TEH) of fairway wood golf clubs is between 1.1 inches and 2.1 inches.

In fact, most fairway wood type golf club heads fortunate to have a small Ycg distance are plagued by a short blade length (BL), a small heel blade length section (Abl), and/or long club moment arm (CMA). With reference to FIG. 3, one particular embodiment achieves improved performance with the Ycg distance less than 0.65 inches, while still achieving a long blade length of at least 3.1 inches, including a heel blade length section (Abl) that is at least 1.1 inches, a club moment arm (CMA) of less than 1.1 inches, and a transfer distance (TD) of at least 1.2 inches, wherein the transfer distance (TD) is between 10 percent to 40 percent greater than the club moment arm (CMA). As with the prior disclosure, these relationships are a delicate balance among many variables, often going against traditional club head design principles, to obtain desirable performance. Still further, another embodiment has maintained this delicate balance of relationships while even further reducing the Ycg distance to less than 0.60 inches.

As previously touched upon, in the past the pursuit of high MOIy fairway woods led to oversized fairway woods attempting to move the CG as far away from the face of the club, and as low, as possible. With reference again to FIG. 8, this particularly common strategy leads to a large club moment arm (CMA), a variable that the present embodiment seeks to reduce. Further, one skilled in the art will appreciate that simply lowering the CG in FIG. 8 while keeping the Zcg distance, seen in FIGS. 2 and 6, constant actually increases the length of the club moment arm (CMA). The present invention is maintaining the club moment arm (CMA) at less than 1.1 inches to achieve the previously described performance advantages, while reducing the Ycg distance in relation to the top edge height (TEH); which effectively means that the Zcg distance is decreasing and the CG position moves toward the face, contrary to many conventional design goals.

As explained throughout, the relationships among many variables play a significant role in obtaining the desired performance and feel of a fairway wood. One of these important relationships is that of the club moment arm (CMA) and the transfer distance (TD). The present fairway wood has a club moment arm (CMA) of less than 1.1 inches and a transfer distance (TD) of at least 1.2 inches; however in one particular embodiment this relationship is even further refined resulting in a fairway wood golf club having a ratio of the club moment arm (CMA) to the transfer distance (TD) that is less than 0.75, resulting in particularly desirable performance. Even further performance improvements have been found in an embodiment having the club moment arm (CMA) at less than 1.0 inch, and even more preferably, less than 0.95 inches. A somewhat related embodiment incorporates a mass distribution that yields a ratio of the Xcg distance to the Ycg distance of at least two, thereby ensuring the performance and feel of a fairway wood golf club head having a second moment of inertia (MOIfc) of at least 4250 $g*cm^2$. In fact, in these embodiments it has been found that a first moment of inertia (MOIy) about a vertical axis through the CG of at least 2000 $g*cm^2$, when combined with the claimed transfer distance (TD), yield acceptable second moment of inertia (MOIfc) values that provide a comfortable feel to most golfers. One particular embodiment further accommodates the resistance that modern golfers are familiar with when attempting to bring the club face square during a golf swing by incorporating a ratio of a second moment of inertia (MOIfc) to the club length that is at least 95.

Achieving a Ycg distance of less than 0.65 inches requires a very light weight club head shell so that as much discretionary mass as possible may be added in the sole region without exceeding normally acceptable head weights for fairway woods, as well as maintaining the necessary durability. In one particular embodiment this is accomplished by constructing the shell out of a material having a density of less than 5 $g/cm^3$, such as titanium alloy, nonmetallic composite, or thermoplastic material, thereby permitting over one-third of the final club head weight to be discretionary mass located in the sole of the club head. One such nonmetallic composite may include composite material such as continuous fiber pre-preg material (including thermosetting materials or thermoplastic materials for the resin). In yet another embodiment the discretionary mass is composed of a second material having a density of at least 15 $g/cm^3$, such as tungsten. An even further embodiment obtains a Ycg distance is less than 0.55 inches by utilizing a titanium alloy shell and at least 80 grams of tungsten discretionary mass, all the while still achieving a ratio of the Ycg distance to the top edge height (TEH) is less than 0.40, a blade length (BL) of at least 3.1 inches with a heel blade length section (Abl) that is at least 1.1 inches, a club moment arm (CMA) of less than 1.1 inches, and a transfer distance (TD) of at least 1.2 inches.

A further embodiment recognizes another unusual relationship among club head variables that produces a fairway wood type golf club exhibiting exceptional performance and feel. In this embodiment it has been discovered that a heel blade length section (Abl) that is at least twice the Ycg distance is desirable from performance, feel, and aesthetics perspectives. Even further, a preferably range has been identified by appreciating that performance, feel, and aesthetics get less desirable as the heel blade length section (Abl) exceeds 2.75 times the Ycg distance. Thus, in this one embodiment the heel blade length section (Abl) should be 2 to 2.75 times the Ycg distance.

Similarly, a desirable overall blade length (BL) has been linked to the Ycg distance. In yet another embodiment preferred performance and feel is obtained when the blade length (BL) is at least 6 times the Ycg distance. Such relationships have not been explored with conventional fairway wood golf clubs because exceedingly long blade lengths (BL) would have resulted. Even further, a preferable range has been identified by appreciating that performance and feel become less desirable as the blade length (BL) exceeds 7 times the Ycg distance. Thus, in this one embodiment the blade length (BL) should be 6 to 7 times the Ycg distance.

Just as new relationships among blade length (BL) and Ycg distance, as well as the heel blade length section (Abl) and Ycg distance, have been identified; another embodiment has identified relationships between the transfer distance (TD) and the Ycg distance that produce a particularly playable fairway wood. One embodiment has achieved preferred performance and feel when the transfer distance (TD) is at least 2.25 times the Ycg distance. Even further, a preferable range has been identified by appreciating that performance and feel deteriorate when the transfer distance (TD) exceeds 2.75 times the Ycg distance. Thus, in yet another embodiment the transfer distance (TD) should be within the relatively narrow range of 2.25 to 2.75 times the Ycg distance for preferred performance and feel.

All the ratios used in defining embodiments of the present invention involve the discovery of unique relationships among key club head engineering variables that are inconsistent with merely striving to obtain a high MOIy or low CG using conventional golf club head design wisdom. Numerous alterations, modifications, and variations of the preferred embodiments disclosed herein will be apparent to those skilled in the art and they are all anticipated and contemplated to be within the spirit and scope of the instant invention. Further, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

We claim:

1. A golf club comprising:

a shaft having a proximal end and a distal end;

a grip attached to the shaft proximal end; and a golf club head attached to the shaft distal end producing a club length of at least 41 inches and no more than 45 inches, wherein the golf club head includes:

(a) a face positioned at a front portion of the golf club head where the golf club head impacts a golf ball, the face has a loft of at least 12 degrees and no more than 27 degrees, and the face includes an engineered impact point;

(b) a sole positioned at a bottom portion of the golf club head;

(c) a crown positioned at a top portion of the golf club head;

(d) a skirt positioned around a portion of a periphery of the golf club head between the sole and the crown, wherein the face, sole, crown, and skirt define an outer shell that further defines a head volume that is less than 250 cubic centimeters, and the golf club head has a rear portion opposite the face;

(e) a bore having a center that defines a shaft axis which intersects with a horizontal ground plane to define an origin point, wherein the bore is located at a heel side of the golf club head and cooperates with the shaft for attachment to the golf club head, and wherein a toe side of the golf club head is located opposite of the heel side;

(f) a blade length measured horizontally from the origin point toward the toe side of the golf club head a distance that is generally parallel to the face and the ground plane to the most distant point on the golf club head in this direction, wherein the blade length includes a heel blade length section measured in the same direction as the blade length from the origin point to the engineered impact point;

(g) a club head mass of less than 230 grams;

(h) a center of gravity (CG) located:

(1) vertically toward the top portion of the golf club head from the origin point a distance Ycg of less than 0.65 inches;

(2) horizontally from the origin point toward the toe side of the golf club head a distance Xcg that is generally parallel to the face and the ground plane;

(3) a distance Zcg from the origin toward the rear portion in a direction generally orthogonal to the vertical direction used to measure Ycg and generally orthogonal to the horizontal direction used to measure Xcg, wherein the Zcg distance is less than 0.85 inches;

(4) such that a club moment arm is a distance from the CG to the engineered impact point, a transfer distance is a horizontal distance from the CG to a vertical line extending from the origin point and the transfer distance is the transfer distance is no more than 40 percent greater than the club moment arm, and a CG angle from the origin point to the center of gravity is no more than 25 degrees; and (i) a first moment of inertia (MOIy) about a vertical axis through the CG of at least 2000 g*cm$^2$.

2. The golf club of claim 1, wherein a ratio of a second moment of inertia (MOIfc), about a vertical axis through the origin, to the club length is at least 95.

3. The golf club of claim 2, wherein the club moment arm is less than 1.1 inches, and a ratio of the club moment arm to the heel blade length section is less than 0.9.

4. The golf club of claim 3, wherein the second moment of inertia (MOIfc) is least 4250 g*cm$^2$.

5. The golf club of claim 4, wherein a portion of the shell has a density of less than 5 g/cc and the face includes a top edge height of 1.1-2.1 inches.

6. The golf club of claim 5, wherein the club moment arm is less than 1.0 inches, and the Zcg distance is less than 0.65 inches.

7. The golf club of claim 6, wherein the club moment arm is less than 0.95 inches, the transfer distance that is least 10 percent greater than the club moment arm, and a portion of the shell is made of non-metallic composite material.

8. The golf club of claim 7, wherein the transfer distance is no more than 25 percent greater than the club moment arm, and the second moment of inertia (MOIfc) is least 4500 g*cm$^2$.

9. The golf club of claim 8, wherein the face has a center face progression of less than 0.525 inches.

10. The golf club of claim 9, wherein the Ycg distance is less than 0.60 inches.

11. A golf club comprising:

a shaft having a proximal end and a distal end;

a grip attached to the shaft proximal end; and a golf club head attached to the shaft distal end producing a club length of at least 41 inches and no more than 45 inches, the golf club head having:

(a) a face positioned at a front portion of the golf club head where the golf club head impacts a golf ball, wherein the face has a loft of at least 12 degrees and no more than 27 degrees, and wherein the face includes an engineered impact point;

(b) a sole positioned at a bottom portion of the golf club head;

(c) a crown positioned at a top portion of the golf club head;

(d) wherein an outer shell defines a head volume no more than 250 cubic centimeters, and the golf club head has a rear portion opposite the face and a front-to-back dimension from a furthest forward point on the face to the furthest rearward point at the rear portion of the golf club head;

(e) a bore having a center that defines a shaft axis which intersects with a horizontal ground plane to define an origin point, wherein the bore is located at a heel side of the golf club head and cooperates with the shaft for attachment to the golf club head, and wherein a toe side of the golf club head is located opposite of the heel side;

(f) a blade length measured horizontally from the origin point toward the toe side of the golf club head a distance that is generally parallel to the face and the ground plane to the most distant point on the golf club head in this direction, wherein the blade length includes a heel blade length section measured in the same direction as the blade length from the origin point to the engineered impact point;

(g) a club head mass of less than 230 grams;

(h) a center of gravity located:

(1) vertically toward the top portion of the golf club head from the origin point a distance Ycg, wherein the Ycg distance is less than 0.65 inches;

(2) horizontally from the origin point toward the toe side of the golf club head a distance Xcg that is generally parallel to the face and the ground plane; and (3) a distance Zcg from the origin toward the rear portion in a direction generally orthogonal to the vertical direction used to measure Ycg and generally orthogonal to the horizontal direction used to measure Xcg, wherein the Zcg distance is less than 0.65 inches;

(4) such that a club moment arm is a distance from the CG to the engineered impact point, a transfer distance is a horizontal distance from the CG to a vertical line extending from the origin point; and (i) a first moment of inertia (MOIy) about a vertical axis through the CG, a second moment of inertia (MOIfc) about a vertical axis through the origin, and a ratio of the first moment of inertia (MOIy) to the club head mass is at least 14.

12. The golf club of claim 11, wherein the face includes a top edge height of no more than 2.1 inches and the head volume is 170-250 cubic centimeters.

13. The golf club of claim 12, wherein a ratio of the second moment of inertia (MOIfc) to the club length is at least 95.

14. The golf club of claim 13, wherein the first moment of inertia (MOIy) is at least 3000 $g*cm^2$ and the second moment of inertia (MOIfc) is at least 4250 $g*cm^2$.

15. The golf club of claim 14, wherein the top edge height is at least 1.1 inches, and the second moment of inertia (MOIfc) about a vertical axis through the origin of at least 4500 $g*cm^2$.

16. The golf club of claim 15, wherein the face has a center face progression of less than 0.525 inches.

17. The golf club of claim 16, wherein a ratio of the second moment of inertia (MOIfc) to the club head mass is at least 23.

18. The golf club of claim 16, wherein a discretionary weight is attached to the shell and has a density of at least 15 g/cc.

19. The golf club of claim 15, wherein the Ycg distance is less than 0.60 inches.

20. The golf club of claim 19, wherein the Ycg distance is less than 0.55 inches.

* * * * *